US007547009B2

(12) United States Patent
Isobe et al.

(10) Patent No.: US 7,547,009 B2
(45) Date of Patent: Jun. 16, 2009

(54) SHEET PROCESSING APPARATUS AND IMAGE FORMING APPARATUS

(75) Inventors: Kenichirou Isobe, Shizuoka-Ken (JP); Junichi Sekiyama, Numazu (JP); Hiroharu Tsuji, Numazu (JP); Naonori Kayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 191 days.

(21) Appl. No.: 11/415,186

(22) Filed: May 2, 2006

(65) Prior Publication Data

US 2006/0255524 A1 Nov. 16, 2006

(30) Foreign Application Priority Data

May 13, 2005 (JP) ..... 2005-141993

(51) Int. Cl.
*B65H 37/04* (2006.01)

(52) U.S. Cl. ..... 270/58.11; 270/58.07; 270/58.08; 270/58.12; 270/58.16

(58) Field of Classification Search ..... 270/58.07, 270/58.08, 58.11, 58.12, 58.16
See application file for complete search history.

(56) References Cited

U.S. PATENT DOCUMENTS 5,201,517 A * 4/1993 Stemmle ..... 271/291
5,290,020 A * 3/1994 Matsui et al. ..... 270/58.19
5,772,197 A * 6/1998 Aoki et al. ..... 270/58.08
6,233,427 B1 * 5/2001 Hirota et al. ..... 399/407
6,450,934 B1 * 9/2002 Coombs ..... 493/383
6,773,005 B2 * 8/2004 Sato et al. ..... 270/58.11
6,942,206 B2 9/2005 Kuwata et al. ..... 270/58.08
2005/0035535 A1 2/2005 Ogata et al. ..... 271/220
2005/0220521 A1 10/2005 Kuwata et al. ..... 399/407
2005/0248085 A1 11/2005 Sekiyama et al. ..... 271/293
2006/0071423 A1 4/2006 Ata et al. ..... 271/303
2006/0082047 A1 4/2006 Fukatsu et al. ..... 271/220

FOREIGN PATENT DOCUMENTS

JP 2003-73012 3/2003

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

So as to more effectively prevent each sheet from being caught, a guide member is provided in a region that extends from an intermediate stacking portion to a staple cartridge portion across a stapler portion main body in a binding portion that performs a binding operation on sheets.

11 Claims, 19 Drawing Sheets

VIEW ON ARROW B

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and more particularly, to a sheet processing apparatus that performs processing on sheets.

2. Description of the Related Art

A conventional image forming apparatus such as a printer may include a sheet processing apparatus that aligns the end portions of sheets on which images have been formed (printed) and performs post-processing such as stapling on the aligned sheets before discharge. Japanese Unexamined Patent Publication No. 2003-073012 discloses a structure in which a sheet processing apparatus is connected to an image forming apparatus and is set above the image forming apparatus.

As an example of such a sheet processing apparatus, an apparatus to be provided on the downstream side of the sheet discharge outlet of the main body of an image forming apparatus is known. This sheet processing apparatus aligns the end portions of sheets that are supplied one by one through a discharge outlet after printing is performed in the main body of the apparatus, and guides the sheets into the opening in a stapling device. The sheet processing apparatus then performs post-processing on the sheets, and discharges the sheets.

Also, to perform precise alignment, a stapling device is normally equipped with a sheet holding portion that prevents a subsequent sheet from pushing an aligned precedent sheet and disturbing the alignment when sheets are being supplied one by one.

In a sheet processing apparatus with such a stapling function, it is essential to perform post-processing without disturbing the alignment of sheets, and discharge the sheets in a bundle without damage.

However, as shown in FIG. 14, a stapling portion 1401 and an intermediate stacking portion 1402 that aligns sheets are normally formed as separate portions. Therefore, there is always a space or a step formed between those two portions.

Also in the stapling portion 1401, as shown in FIG. 15, a space or a step always exists between a stapling portion main body 1401*a* and a staple cartridge portion 1402*b*.

Therefore, when the end portion of a sheet with a large curl enters the opening of the stapler during an aligning operation in a direction substantially perpendicular to the conveying direction, a problem might be caused as the sheet is caught in the space between the staple portion 1401 and the intermediate stacking portion 1402 or in the space between the stapling portion main body 1401*a* and the staple cartridge portion 1401*b*, as shown in FIG. 16.

To counter this problem, the following measures have been taken in conventional apparatuses. As shown in FIG. 17, a guide plate 1403 is provided on the bottom face of the opening of the stapling portion 1401. Alternatively, a guide member 1404 that extends upward from the stacking face as it nears to the opening of the stapling portion 1401 may be provided on an intermediate stacking face in the vicinity of the opening of the stapling portion 1401, as shown in FIG. 18.

In those structures, sheets can be effectively prevented from being caught in the space or the step between the portions. However, since the space between the portions remains unfilled, the above measures are not effective for sheets with large curls.

SUMMARY OF THE INVENTION

Therefore, the object of the present invention is to provide a sheet processing apparatus that can more effectively prevent problems such as sheet jamming in a sheet binding portion.

Another object of the present invention is to solve such problem that if the guide member is located on the downstream side of the staple thrusting position, when a bundle of stapled sheets is discharged, the protruding portion of a finished staple on the back face of the sheet at the bottom is caught by the guide member. This problem can be solved in the present invention.

To achieve that object, according to the present invention, there is provided a sheet processing apparatus comprising:

a sheet stacking portion on which sheets conveyed through a sheet conveyance path are stacked;

a sheet aligning portion which aligns the sheets stacked on the sheet stacking portion;

a sheet binding portion which performs a binding operation on the sheets aligned in a predetermined position by the sheet aligning portion; and a guide member which guides ends of the sheets aligned by the sheet aligning portion to the predetermined position, the guide member being provided between the sheet stacking portion and the sheet binding portion, wherein the sheet binding portion performs the binding operation by thrusting a staple, at a staple thrusting position, onto the sheets aligned in the predetermined position, the guide member is provided on an upstream side of the staple thrusting position of the sheet binding portion in the sheet conveying direction.

According to the present invention, problems such as sheet jamming in a sheet biding portion can be more effectively prevented.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1:
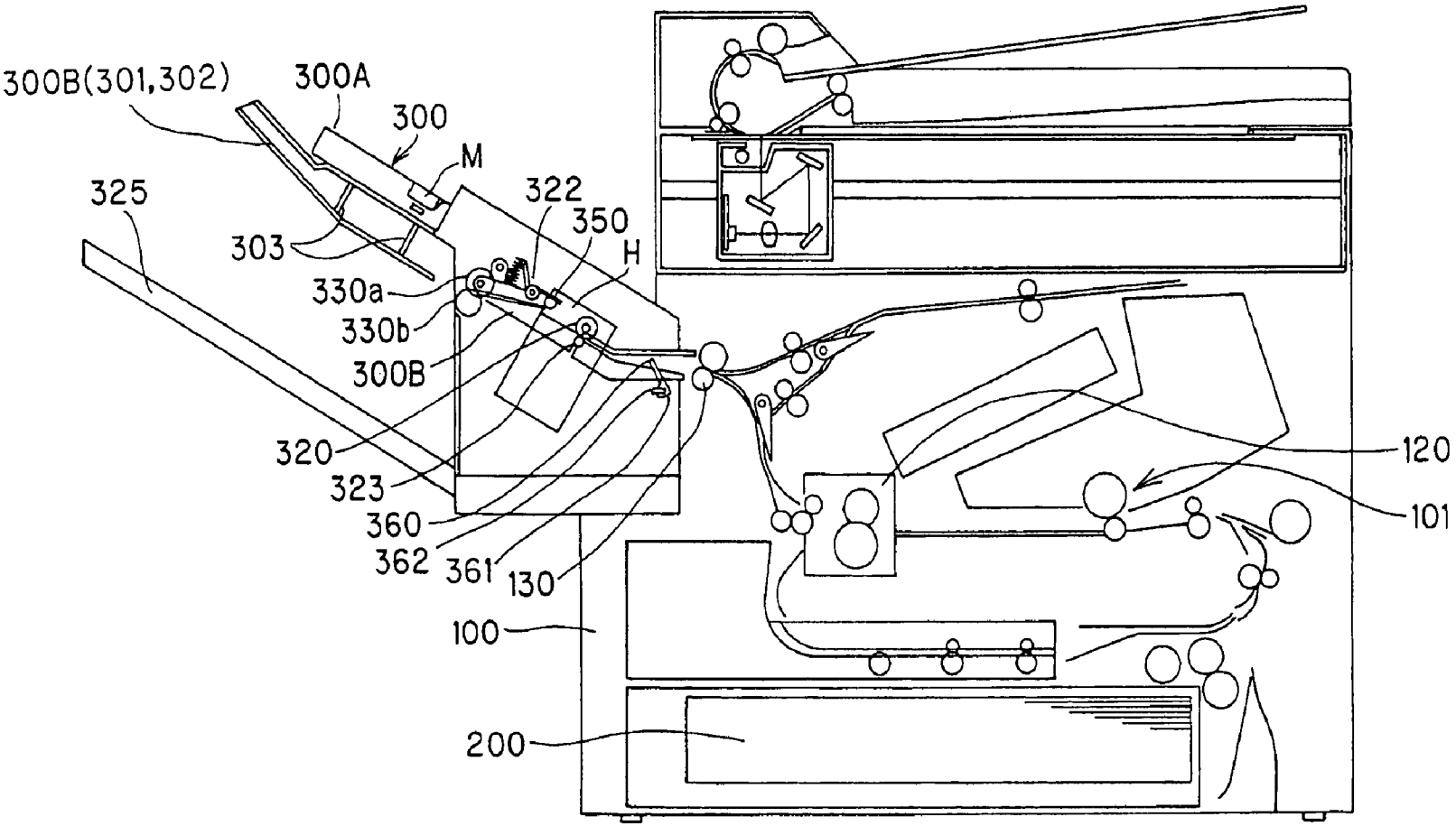
FIG. 1 is a schematic cross-sectional view of a printer that is equipped with a sheet processing apparatus according to a first embodiment of the present invention.

The following is a description of embodiments of the present invention, with reference to the accompanying drawings. In those drawings, like components are denoted by like reference numerals. The sizes, materials, shapes, and arrangement of the components described below may be changed with the structures and conditions to which the present invention is applied, and the present invention is not limited to the following embodiments.

In the following description of the embodiments, sheet processing apparatuses to be implemented in image forming apparatuses such as laser beam printers will be described.

First Embodiment

Referring first to FIGS. 1 to 6C, the structures of a printer main body and a sheet processing apparatus and a series of operations according to a first embodiment of the present invention are described. FIG. 1 illustrates the entire structure of a sheet processing apparatus (a sheet post-processing apparatus) and an image forming apparatus (a printer) according to the first embodiment of the present invention.

In FIG. 1, a printer main body 100 is shown as an image forming apparatus. The printer main body 100 is solely connected to a computer or connected to a network such as a LAN. Based on image information and print signals transmitted from the computer or the network, the printer main body 100 performs image formation (printing) on sheets according to a predetermined image forming process, and discharges those sheets.

Meanwhile, a sheet processing apparatus 300 performs processing on the sheets discharged out of the printer main body 100. Those sheets are first conveyed through a conveying portion in the sheet processing apparatus 300 and are stacked on a sheet stacking portion in a face-down state in which the image formation face of each sheet faces down. The sheets are then aligned by a sheet aligning portion, and are bound in each job. The bound sheets are stapled at one point or two or more points. The sheets are then discharged onto a stacking portion (a discharge portion) 325 of the sheet processing apparatus 300, or are discharged, while remaining in the face-down state, onto the stacking portion 325 of the sheet processing apparatus 300.

The sheet processing apparatus 300 and the printer main body 100 are electrically connected to each other with a cable connector (not shown). The sheet processing apparatus 300 has a casing portion 300A that houses each component and can be detachably attached to the printer main body 100.

Next, the structure of each component of the printer main body 100 is described according to the sheet conveying path through which each sheet S is to be conveyed.

In the printer main body 100, sheets S are stacked in a sheet feeding cassette 200, and the uppermost sheet of the stack is separated from the other sheets and is conveyed one by one by various rollers. Based on predetermined print signals supplied from a computer or a network, a toner image is transferred onto the upper face of each sheet S fed from the sheet feeding cassette 200 at image forming portion 101 which forms toner image through the image forming process according to the so-called laser beam method in the printer main body 100. A fixing portion 120 located on the downstream side applies heat or pressure onto the upper face of each sheet S, so as to fix the toner image permanently onto the sheet S.

The sheet S having the image fixed thereon is then discharged out of the printer main body 100 by a discharge roller 130, as shown in FIG. 1.

Figure 2A:
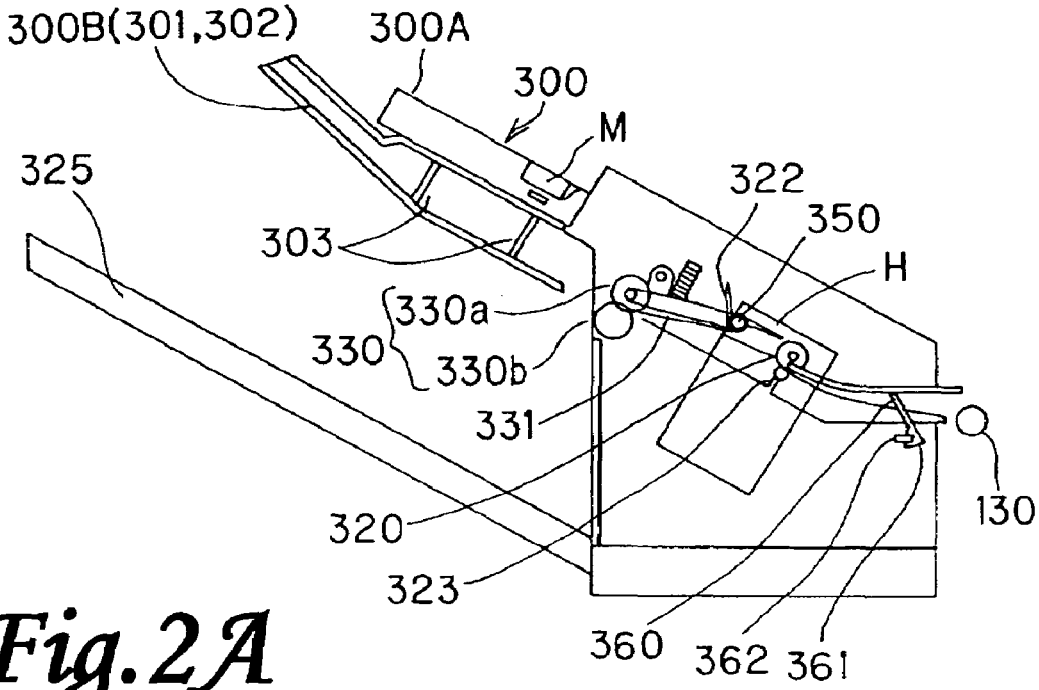
FIGS. 2A and 2B are views illustrating the operation of the sheet processing apparatus according to the first embodiment of the present invention.
Figure 2B:
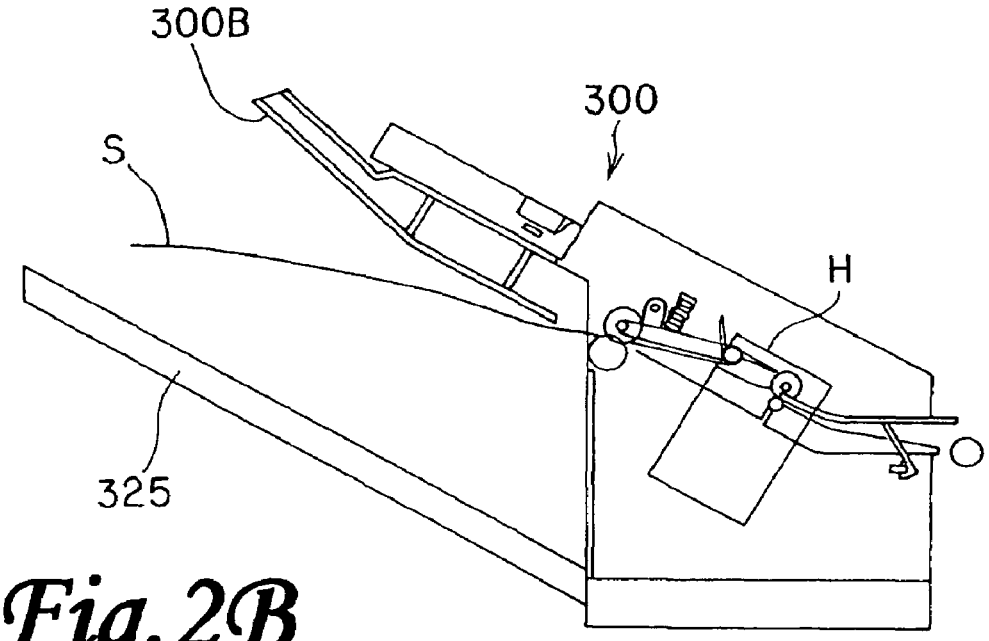
Figure 3A:
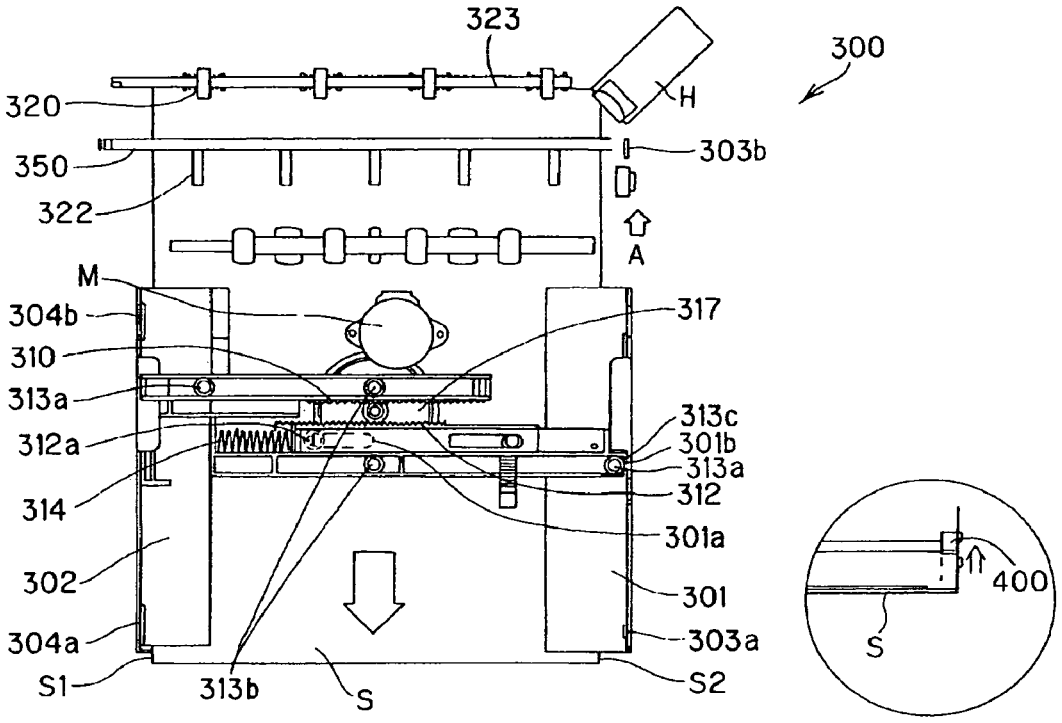
FIGS. 3A and 3B are schematic cross-sectional views illustrating the operation of the slide guides according to the first embodiment, where the slide guides are in the stand-by positions.
Figure 3B:
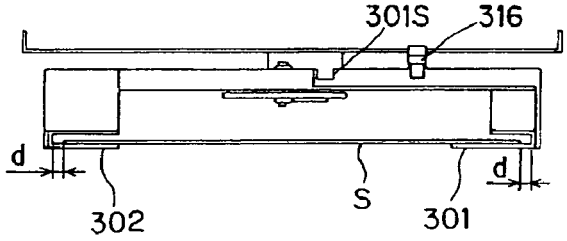

Next, the structure of the sheet processing apparatus 300 and the operation to be performed in a case where a sheet S is conveyed to the sheet processing apparatus 300 by the discharge roller 130 are described, with reference to FIGS. 2A through 3B. FIGS. 2A and 2B are schematic cross-sectional views of the discharge roller 130 and the sheet processing apparatus 300. FIGS. 3A and 3B are schematic cross-sectional views of the sheet processing apparatus 300.

In FIG. 2, reference numeral 330*a* denotes an upper discharge roller, reference numeral 330*b* denotes a lower discharge roller, the alphabet M denotes a jogger motor as a drive source, reference numeral 322 denotes a paddle, and reference numeral 323 denotes an alignment wall with which the bottom end of each sheet is brought into contact.

As shown in FIG. 2A, the discharge roller pair 330 that includes the upper discharge roller 330*a* and the lower discharge roller 330*b* is disposed in a higher position on the downstream side in the sheet conveying direction, and is rotationally driven by a driving motor (not shown).

The upper discharge roller 330*a* is axially supported by an arm 331 that is rotatable about a paddle axis 350. The jogger motor M is to drive slide guides 301 and 302 that will be described later.

The paddle 322 is made of an elastic material such as rubber, and several such paddles are fixed to the paddle axis 350 in a direction substantially perpendicular to the sheet conveying direction. As the paddle axis 350 is driven to rotate counterclockwise, the sheet S is moved in the opposite direction from the sheet conveying direction, so that the end of the sheet S is brought into contact with the alignment wall 323.

As shown in FIGS. 3A and 3B, the sheet processing apparatus 300 of the first embodiment has the slide guide 301 and the slide guide 302 as an aligning member that move in the sheet width direction as a sheet aligning portion for aligning sheets in the sheet width direction intersect with (substantially perpendicular to) the sheet conveying direction. The slide guide 301 and the slide guide 302 will be described in detail. The sheet S is then introduced to the inlet portion of the sheet processing apparatus 300 by the discharge roller 130 of the printer main body 100.

The sheet S introduced to the sheet processing apparatus 300 is detected by a photosensor 362 that is caused to transmit light by a flag 361 provided in an inlet sensor 360. The sheet S is then conveyed upward by an inlet roller pair 320.

In the sheet processing apparatus 300, the sheets S are stapled and are then discharged onto the stacking portion 325, or the sheets S are not stapled and are then discharged onto the stacking portion 325.

Figure 5A:
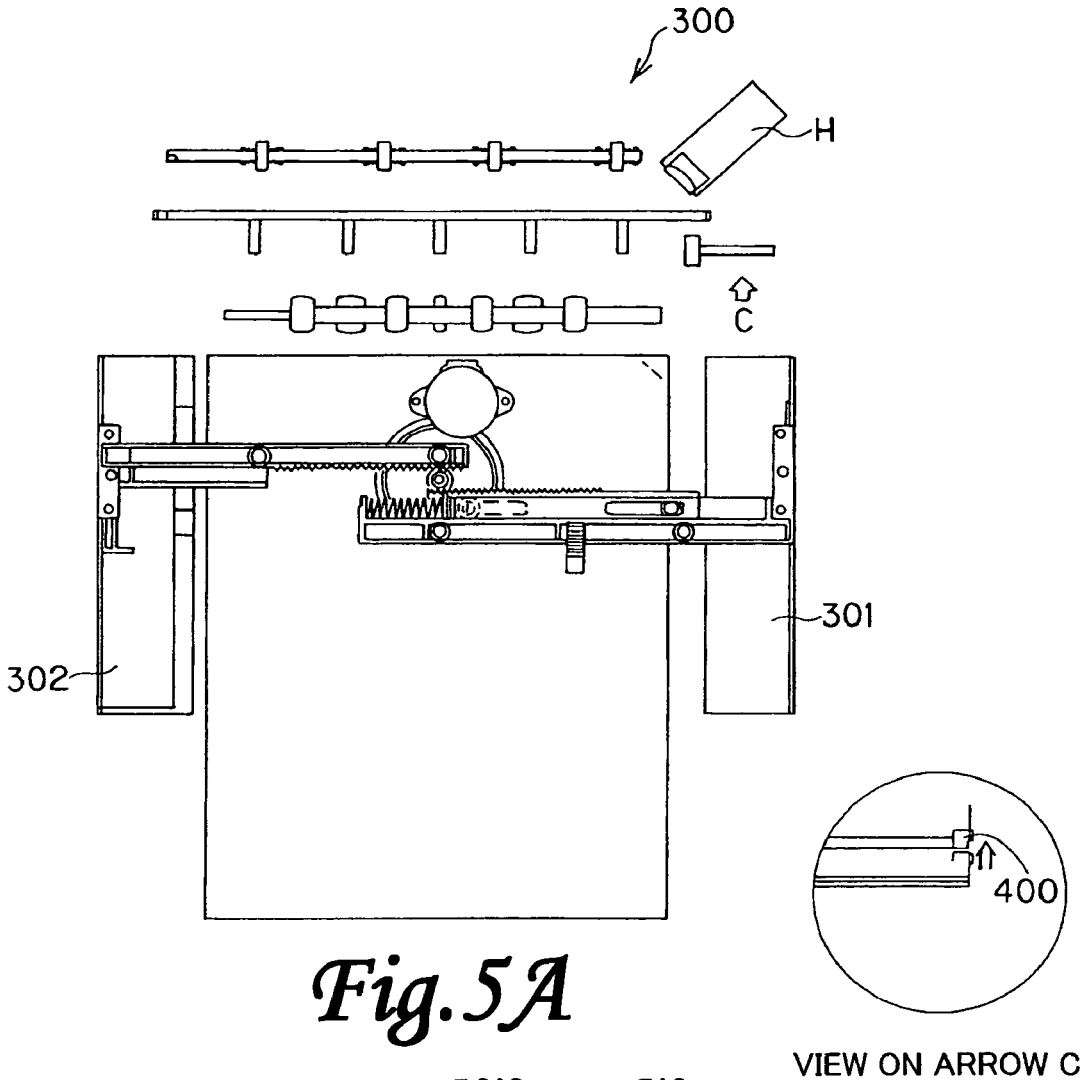
FIGS. 5A and 5B are schematic cross-sectional views illustrating the operation of the slide guides according to the first embodiment, where the slide guides are located in the home position and a bundle of sheets is dropped.
Figure 5B:
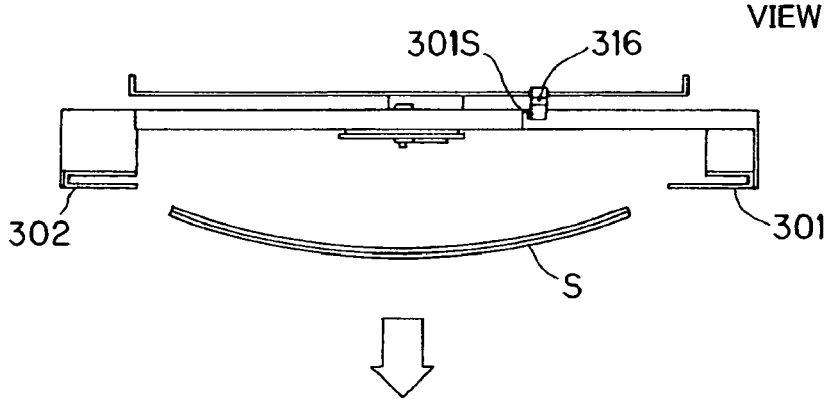

First, the operation to be performed in the case where discharge and stacking in the stacking portion 325 of the sheet processing apparatus 300 are performed without post-processing is described, with reference to FIGS. 2A and 2B and FIGS. 5A and 5B. FIGS. 5A and 5B are schematic cross-sectional views illustrating the operations of the slide guides 301 and 302. In the situation illustrated in FIGS. 5A and 5B, the slide guides 301 and 302 are located in their home positions, and a bundle of sheets is being dropped.

As shown in FIG. 5A, when discharge and stacking are performed without post-processing in the sheet processing apparatus 300, the bottom faces of the right-side slide guide 301 and the left-side slide guide 302 are retracted to positions in which the sheets S to be introduced cannot be in contact with the slide guides 301 and 302. Accordingly, the bottom faces of the slide guides 301 and 302 are retracted to positions that are located outside the width direction of the sheets S by a predetermined distance, and the sheets S are conveyed directly to the stacking portion 325 of the sheet processing apparatus 300.

After passing through the inlet roller pair 320, the sheets are conveyed by the discharge roller pair 330 and are stacked on the stacking portion 325 of the sheet processing apparatus 300.

Referring now to FIGS. 3A and 3B and FIGS. 6A through 6C, the operation of discharging and stacking stapled sheets on the stacking portion 325 of the sheet processing apparatus 300 is described. In the situation illustrated in FIGS. 6A through 6C, sheets are aligned by the slide guides 301 and 302.

As shown in FIG. 3A, in the sheet processing apparatus 300, alignment plates 303*a* and 303*b* and alignment plates 304*a* and 304*b* provided on the walls of the right-side slide guide 301 and the left-side slide guide 302 are retracted to positions each located outside the width direction of the sheets S by a predetermined distance, so as not to interfere with the movement of the sheets S being conveyed. The bottom end faces of the slide guides 301 and 302 are located in positions within the width region of the sheets S, so as to stand by for the introduction of the sheets S. Those positions are the "stand-by positions".

After each sheet S conveyed by the discharge roller 130 passes through the inlet roller pair 320, the sheet S is conveyed by the discharge roller pair 330 onto the guide face of a sheet stacking portion 300B that includes the slide guide 301 and the slide guide 302.

Figure 6A:
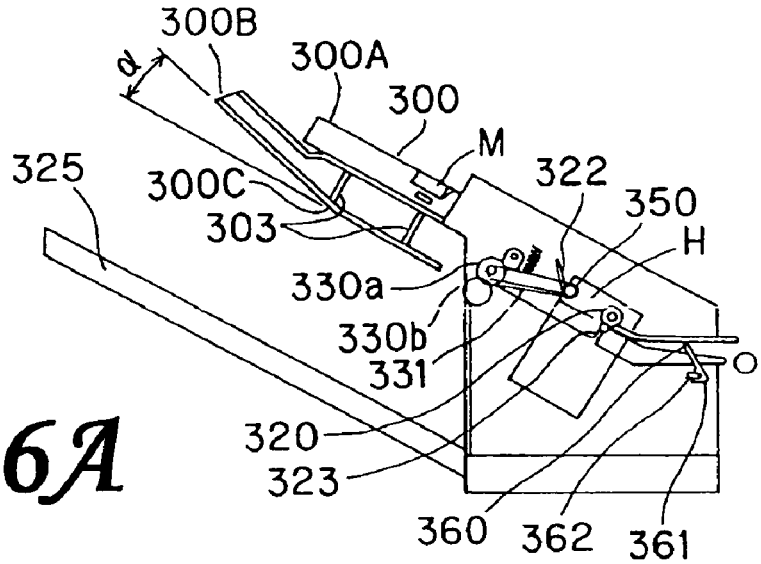
FIGS. 6A through 6C are views illustrating a situation in which sheets are aligned by the slide guides in the first embodiment.

The guide face of the sheet stacking portion 300B is tilted at predetermined degrees with respect to the horizontal direction, and the angle of gradient of the guide face on the upstream side in the sheet conveying direction differs from the angle of gradient of the guide face on the downstream side in the sheet conveying direction, as shown in FIG. 6A. More specifically, the guide face of the sheet stacking portion 300B has a bent portion 300C at which the guide face is bent at a gradient angle $\alpha$ between a predetermined upstream portion and a predetermined downstream portion. Since the guide face of the sheet stacking portion 300B has such a bent portion 300C, deflection at the center of each sheet S that is not guided by the slide guides 301 and 302 is prevented.

Immediately after the first sheet S is conveyed onto the plane formed by the slide guide 301 and the slide guide 302, the arm 331 rotates clockwise to retract upward the upper discharge roller 330*a* axially supported by the arm 331. When the discharge roller pair 330 are separated from each other, the drive connected to the discharge roller pair 330 is cut off so as to stop the rotation of the upper discharge roller 330*a* and the lower discharge roller 330*b*.

After passing through the inlet roller pair 320, the sheet S returns in the opposite direction from the sheet conveying direction by virtue of its own weight, and moves toward the alignment wall 323.

Only the left-side slide guide 302 then operates to start the operation of aligning each sheet to be stacked in the sheet stacking portion 300B in the width direction.

More specifically, the slide guide 302 is driven by the motor M and moves toward the right-hand side in FIGS. 3A and 3B, so that the alignment plates 304*a* and 304*b* attached to the slide guide 302 are brought into contact with the left side of the sheet S and push the sheet S toward the slide guide 301. The right side of the sheet S then comes into contact with the alignment plate 303*a* attached to the slide guide 301 and the alignment plate 303*b* provided in the vicinity of a stapler H. The sheet S is thus aligned in its width direction.

The slide guide 302 then moves slightly out of the width region of the sheet S. At this point, the bottom end of the sheet S is brought into contact with the alignment wall 323 by a sheet conveying direction aligning portion. Thus alignment in the conveying direction is performed. Through the above procedures, the sheet S is moved to the predetermined stapling position. After the aligning operation for each sheet, the slide guide 302 moves out of the width region of the sheets S, and again stands by for the next sheet in the stand-by position.

Referring now to FIGS. 3A through 5B, the structures of the slide guides are described in detail. FIGS. 4A and 4B are schematic cross-sectional views illustrating the operations of the slide guides. In the situation illustrated in FIGS. 4A and 4B, sheets are aligned by the slide guides.

Each of the slide guides 301 and 302 are guided by four guide pins: guide pins 313*a* provided on a frame (a mold frame in the first embodiment) of the sheet processing apparatus 300 and guide pins 313*b* provided on a frame (a sheet metal frame in the first embodiment) of the sheet processing apparatus 300. With this structure, the slide guides 301 and 302 can reciprocate in the transverse direction in FIGS. 3A and 3B, or in a direction (the sheet width direction) substantially perpendicular to the sheet conveying direction. The slide guides 301 and 302 move by virtue of transmission of driving force from the jogger motor M.

When seen from the downstream side of the sheet conveying direction, the slide guides 301 and 302 each have a wall portion that guides both sides of each sheet S, and a support portion that supports the upper and lower faces of each sheet S, as shown in FIG. 3B. The wall portion and the support portion form such a shape that each sheet S to be discharged into the sheet stacking portion 300B is supported by the lower faces of the slide guides 301 and 302, while the middle portion of each sheet S in the width direction is not guided.

As shown in FIG. 3A, the slide guide 302 has a slide rack portion 310 that has a plate gear to be meshed with a step gear 317. The slide guide 301 also has a slide rack 312 that has a plate gear to be meshed with the step gear 317. The slide rack 312 is attached, in a relatively movable state, to the slide guide 301 via a coil spring 314. The spring 314 has one end in contact with the slide guide 301 and the other end in contact with the slide rack 312. With this arrangement, the spring 314 applies a force in such a direction as to push the slide guide 301 and the slide rack 312 apart from each other. The slide rack 312 also has a rectangular hole 312*a* for moving an emboss portion 301*a* of the slide guide 301.

The alignment plate 303*a* is attached to a side wall of the slide guide 301, and the alignment plate 303*b* is provided near the stapler. The alignment plates 304*a* and 304*b* are provided to a side wall of the slide guide 302. With this structure, when sheets are aligned, the slide guide 302 moves, as described later, so that the alignment plates 304*a* and 304*b* and the alignment plates 303*a* and 303*b* are brought into contact with the side end faces S1 and S2 of each sheet.

The slide guide 301 and the slide guide 302 are supported in the height direction by the step gear 317 and the frame body (the sheet metal frame).

In FIGS. 3A through 5B, the alphabet H denotes the stapler as the sheet binding portion that staples sheets (post-processing or a binding operation). This stapler H performs stapling at the upper left corner of the image formation face of each sheet on which an image has been formed. Therefore, the stapler H is fixed on the side of the slide guide 301 in the sheet processing apparatus 300.

Next, the operations of the slide guides 301 and 302 are described.

When the sheet processing apparatus 300 is activated, the discharge roller pair 330 starts rotating, driven by the driving motor. The jogger motor M then revolves so as to rotate the step gear 317. By doing so, the rack portion 310 of the slide guide 302 is driven and retracted to the outside. As the step gear 317 rotates together with the jogger motor M, the slide rack 312 of the slide guide 301 moves relatively, and, after the rectangular hole 312*a* of the slide rack 312 is brought into contact with the right-side end face of the emboss portion 301*a* of the slide guide 301 shown in FIG. 3, the slide guide 301 is pushed and retracted to the outside by the rectangular hole 312*a*.

The slide guide 301 has a slit portion 301S. When the slit 301S moves a predetermined retracting distance, light is transmitted to the photosensor 316, and the jogger motor M stops, as shown in FIG. 5A. This position will be hereinafter referred to as the home position.

When a guide signal for a sheet S to be fed to the sheet processing apparatus 300 is input to the sheet processing apparatus 300 from the printer main body 100, the jogger motor M revolves. The slide guides 301 and 302 then move inward and stop at the positions that are outside the width region of the guided sheet S by a predetermined distance d, as shown in FIGS. 3A and 3B. In the position, the slide guide 301 has a stopper 301*b* in contact with an end face 313*c* of a guide pin 313*a*, and becomes unmovable to the inside. The positions of the slide guides 301 and 302 shown in FIGS. 3A and 3B are the stand-by positions. In the stand-by position, the side face of the slide guide 301 is the alignment plane in an aligning operation.

In a case where the size (the width) of the sheet S is the largest possible size for guiding in the first embodiment, the stand-by positions of the slide guides 301 and 302 are set so that the space left at either side is the predetermined distance d.

When sheets with a smaller width are to be aligned by the sheet processing apparatus 300, the slide guide 302 moves toward the right side according to the width of the sheets. In this manner, the space at the left end in FIGS. 3A and 3B is always equivalent to the predetermined distance d.

Figure 4A:
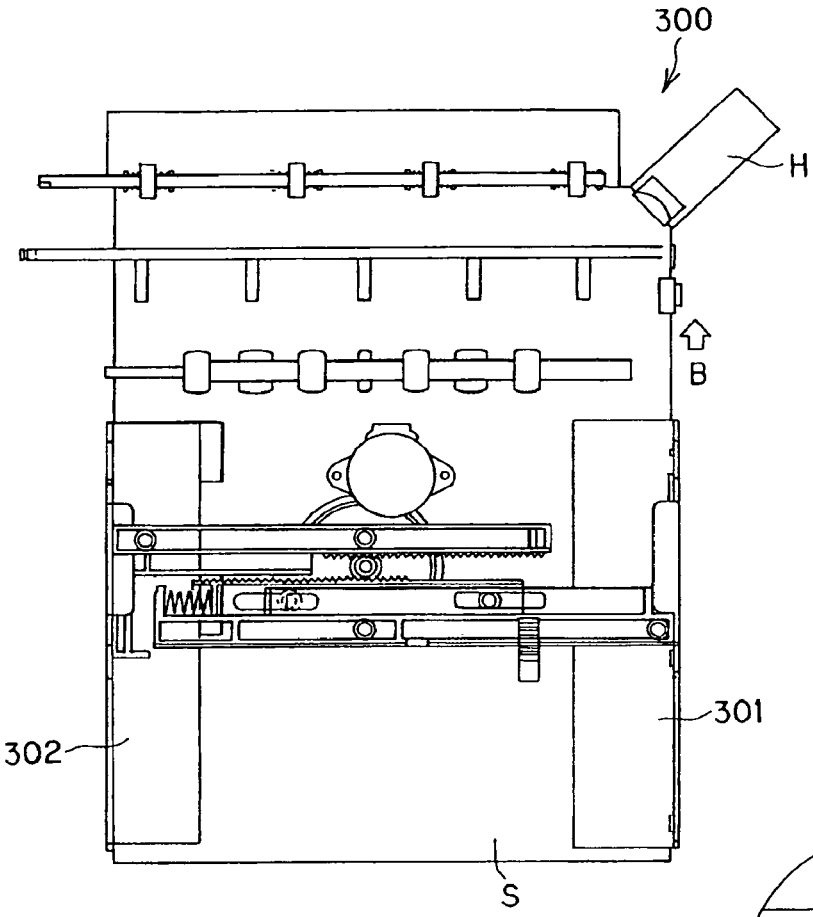
FIGS. 4A and 4B are schematic cross-sectional views illustrating the operation of the slide guides according to the first embodiment, where sheets are aligned by the slide guides.
Figure 4B:
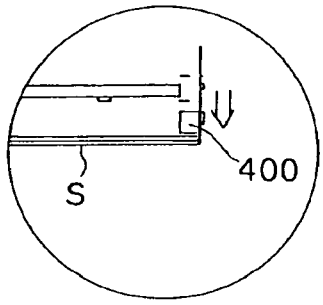
Figure 6B:
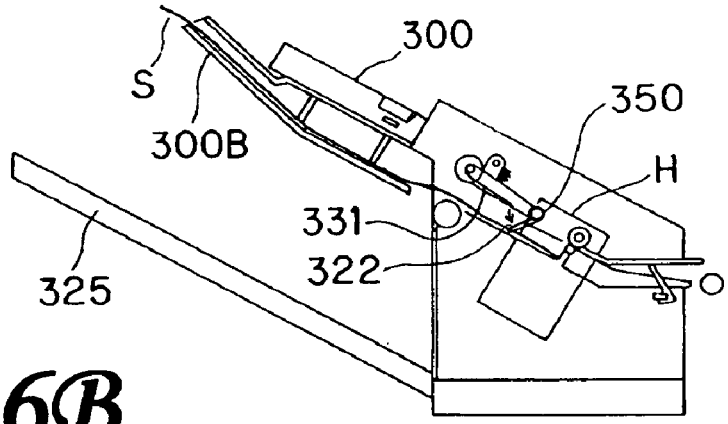

After transverse alignment is performed by the slide guides 301 and 302, the slide guide 302 moves outward from the width region of the sheet S, so as to release the restriction on the sheet S in the transverse alignment direction, as shown in FIGS. 4A and 4B. Thus, the sheet S is put into a movable state in the sheet conveying direction. The paddle 322 then rotates once clockwise about the paddle axis 350, so that the paddle 322 comes in contact with the upper face of the sheet S and the sheet S is brought into contact with the alignment wall 323, as shown in FIG. 6B. Thus, alignment is performed.

Figure 4B:
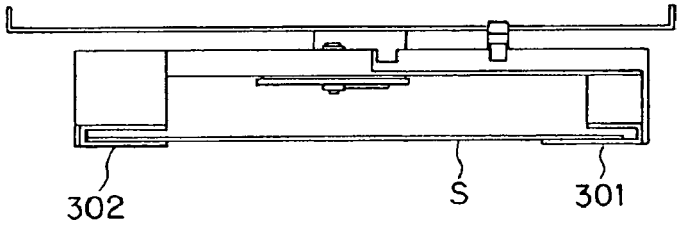

Through the above procedures, alignment in the sheet conveying direction and alignment in a direction substantially perpendicular to the sheet conveying direction can be performed. So as to maintain the aligned state, a lever 400 equipped with a friction member is provided in the vicinity of the right-end face of the aligned sheet as shown in FIG. 4 (see a partially enlarged view B of the structure seen in the direction of the arrow B). After the aligning operation is completed and before the next sheet to be introduced is brought into contact with the aligned sheet, the lever 400 applies pressure onto the upper face of the sheet, so as to prevent the next sheet from moving the aligned sheet. The lever 400 is a part of a sheet holding portion. As shown in the partially enlarged views A through C of the structure seen in the arrows A through C, respectively, in FIGS. 4A through 6C, the lever 400 moves up and down to apply pressure onto the aligned sheets and maintain the aligned state.

After the alignment operation for each sheet S, the slide guide 302 moves further away from the width region of the sheets S and stops in the stand-by position to stand by for the next sheet conveyance.

The operations for the second sheet and later are now described.

While the second sheet or a later sheet is being conveyed, the discharge roller pair 330 is at a distance from each other. When the bottom end of the sheet S passes through the inlet roller pair 320, the sheet S returns in the direction opposite from the conveying direction by virtue of its own weight, and moves toward the alignment wall 323. The alignment operation thereafter is exactly the same as that for the first sheet, and therefore, explanation of it is omitted herein.

The above operation is repeated, and lastly, alignment is performed on the last (the n-th) sheet (Sn) of the job. The alignment plates 304*a* and 304*b* attached to the slide guide 302 bring the left-side face of the sheet into contact with the alignment plate 303*a* of the slide guide 301 and the alignment plate 303*b* provided in the vicinity of the stapler. When the slide guide 302 is stopped and the sheets S are located in a predetermined position as shown in FIGS. 4A and 4B, the small-sized stapler H located on the right side of the bottom end of the bundle of sheets staples the sheets at a point at the right corner of the bottom end.

With this structure and through this operation, the slide guide 301 remains in the alignment position and does not shift during the aligning operation for each sheet, and only the slide guide 302 moves to put the left-side ends of the sheets in the alignment position. Accordingly, the binding operation by the stapler H fixed on the side of the slide guide 301 can be certainly performed with precision. Even if the widths of sheets to be introduced vary in one job or the sheet size switches from "LTR" to "A4" in one job, for example, the left ends of the sheets can be aligned. The result of the binding operation by the stapler H is neat in appearance while being accurate. Thus, an excellent effect can be achieved.

Figure 6C:
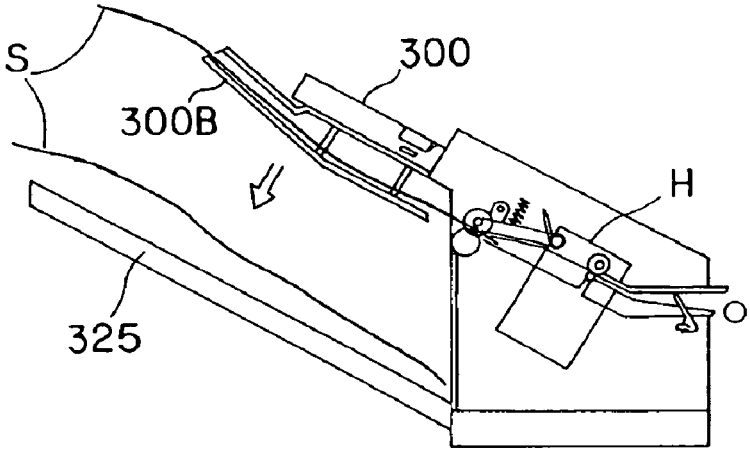

In the first embodiment, when the stapling operation ends, the arm 331 rotates counterclockwise as shown in FIG. 6C. The upper discharge roller 330*a* axially supported by the arm 331 then moves downward, so as to form the discharge roller pair 330. A drive is connected to both rollers of the discharge roller pair 330, so as to start rotating the upper discharge roller 330*a* and the lower discharge roller 330*b*.

Through this operation, the bundle of sheets S is nipped by the upper discharge roller 330*a* and the lower discharge roller 330*b*, and is then conveyed over the face formed by the slide guide 301 and the slide guide 302.

After the bundle of sheets S is discharged from the discharge roller pair 330, the jogger motor M is driven to rotate, so that the slide guide 302 moves further outward in the situation illustrated in FIGS. 4A and 4B. At the start of the movement of the slide guide 302, the slide rack 312 of the slide guide 301 moves to the right in FIGS. 4A and 4B, but the slide guide 301 does not immediately move.

When the slide guide 302 passes through the stand-by position shown in FIGS. 3A and 3B, the emboss portion 312*a* of the slide rack 312 is brought into contact with the end face of the rectangular hole 310*a* of the slide guide 301. The slide guide 301 then start moving to the right side in FIGS. 3A and 3B, and thus, both the slide guides 301 and 302 move.

The stapled sheets drop downward, as shown in FIG. 6C, when the distance between the slide guides 301 and 302 guiding the sheets becomes close to the width of the sheets or wider than the width of the sheets. Thus, the bundle of sheets drops and is stacked on the stacking portion 325 of the sheet processing apparatus 300.

Described above are the structures of the printer main body and the sheet processing apparatus, and the series of operations according to the first embodiment of the present invention.

Next, the structure of a guide member 405 according to the first embodiment of the present invention is described.

FIGS. 7A through 8B illustrate a sheet processing apparatus that has the guide member 405 of the first embodiment and has a stapling function. FIGS. 9A and 9B illustrate a sheet processing apparatus that also has a stapling function and a guide member 1405 as a comparative example.

A stapler H is formed with a stapling portion 401 that includes a staple cartridge portion 401*b* and a stapler main body 401*a*. The staple cartridge portion 401*b* is a cartridge that houses staples, and can be detachably attached to the stapler main body 401*a*.

Figure 17:
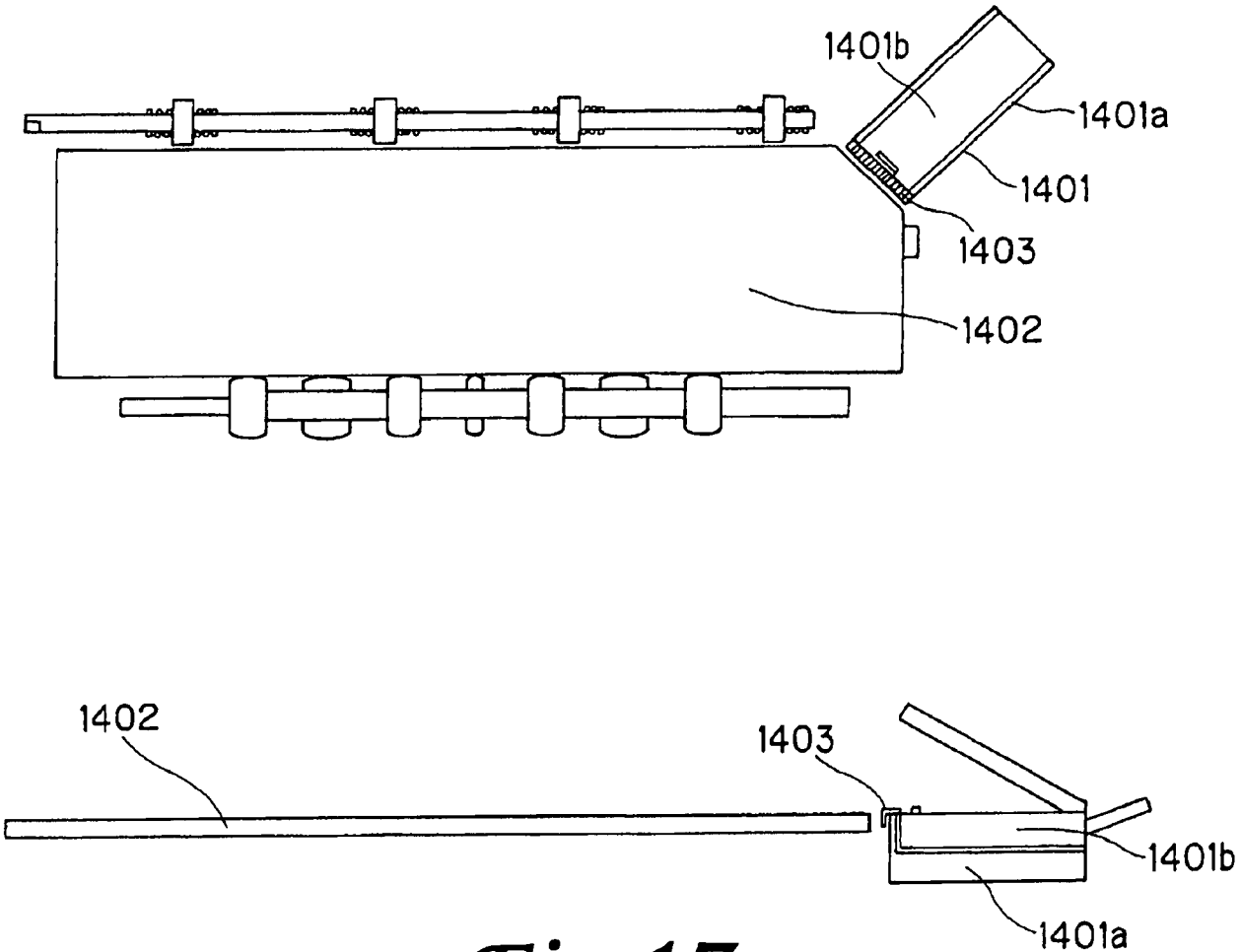
FIG. 17 is a view illustrating a conventional sheet processing apparatus that has a guide member and has a stapling function.
Figure 18:
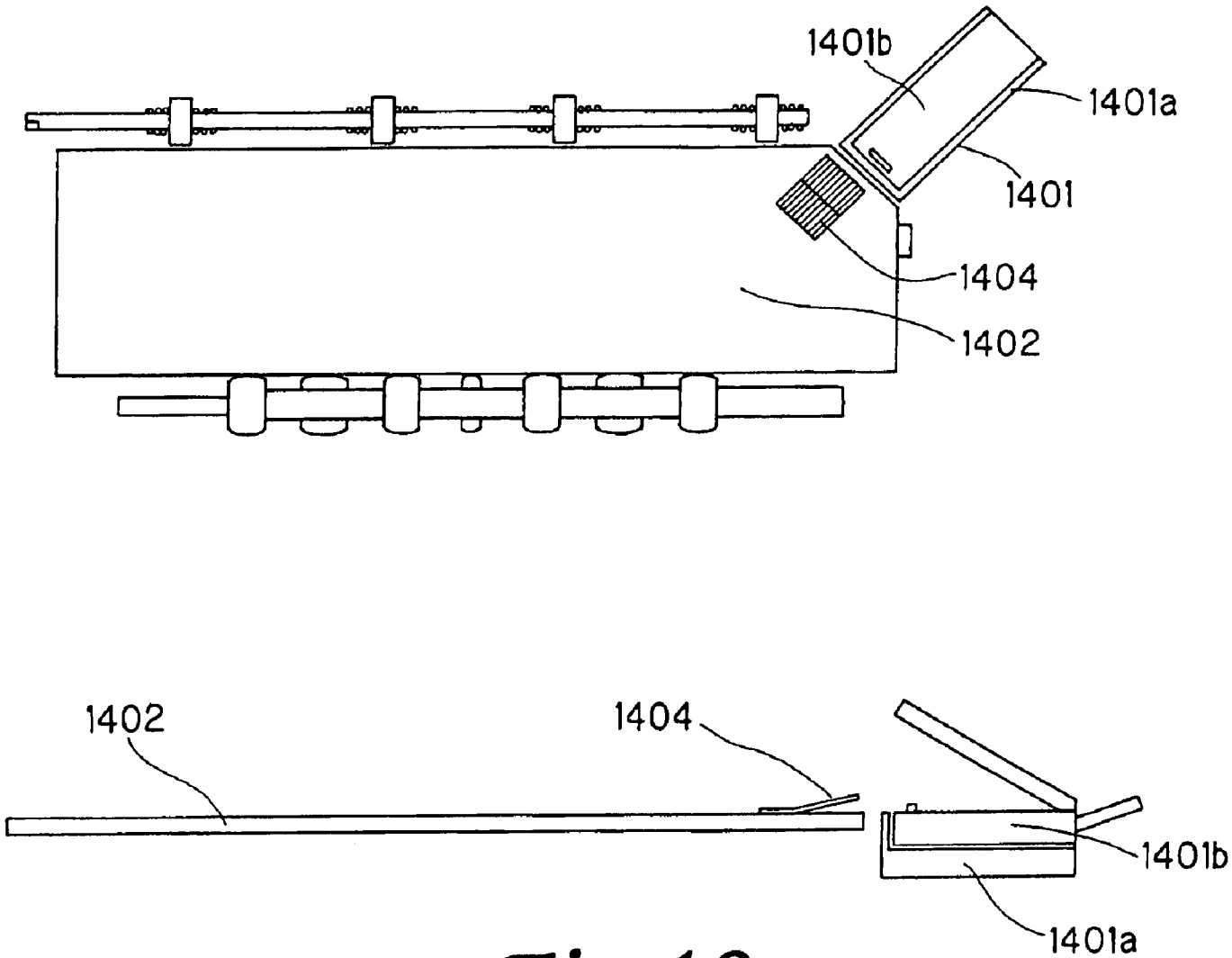
FIG. 18 is a view illustrating a conventional sheet processing apparatus that has a guide member and has a stapling function.

So as to prevent each sheet from getting caught in the space or the step between the stapling portion 401 and an intermediate stacking portion 402 as a sheet stacking portion, or in the space or the step between the stapler main body 401*a* and the staple cartridge portion 401*b*, a conventional apparatus is equipped with a guide plate 1403 around the bottom face of the opening of a stapling portion 1401, as shown in FIG. 17. Alternatively, a guide member 1404 that extends upward from the stacking face as it nears to the opening is provided on the intermediate stacking face near the opening of the stapling portion 1401, as shown in FIG. 18.

Figure 19:
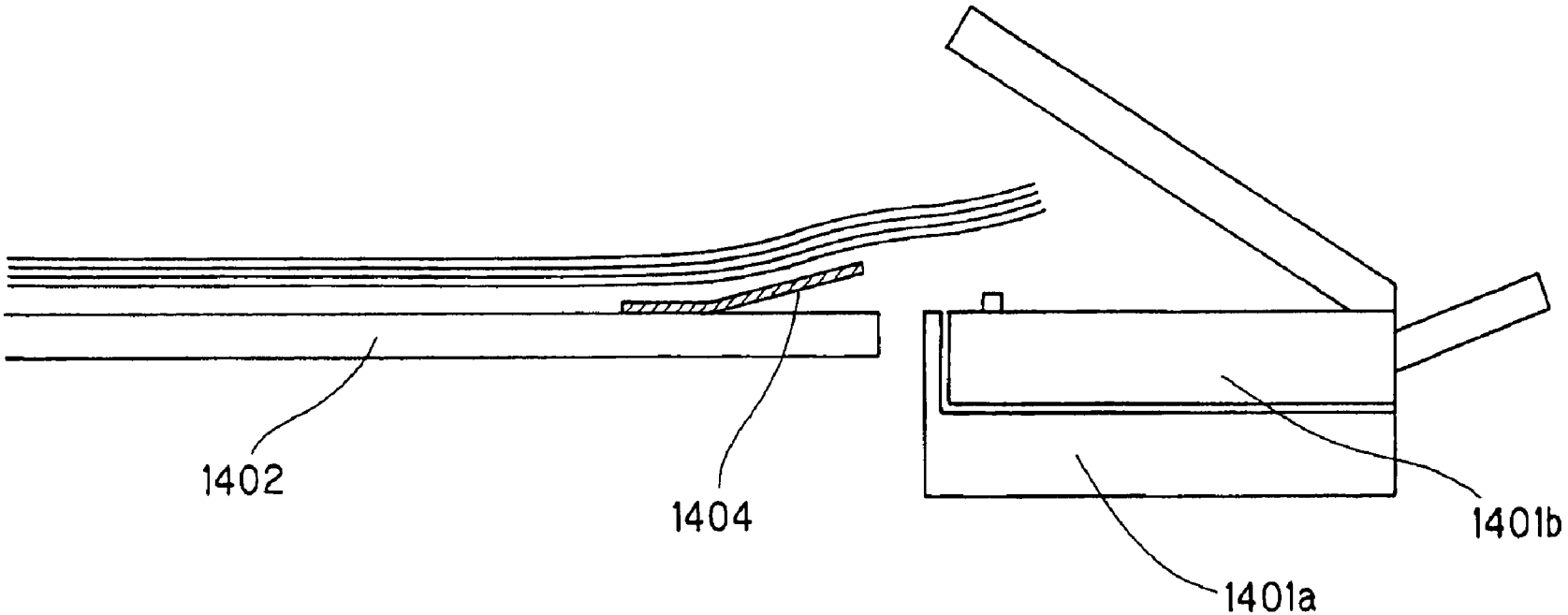
FIG. 19 is a view illustrating an aligning operation of a conventional sheet processing apparatus that has a guide member and has a stapling function.

Those structures effectively prevent each sheet from getting caught in the space or the step between portions. However, the space between the portions is not completely filled, and therefore, a sheet with a large curl cannot be prevented from getting caught between the portions. Also, in the case where the guide member 1404 is provided, the end portions of sheets near the guide member 1404 are aligned in conformity with the shape of the guide member 1404 that extends upward with respect to the sheet stacking face, as shown in FIG. 19. As a result, stable alignment cannot be performed.

As shown in FIG. 7, in the first embodiment of the present invention, on the other hand, the guide member 405 is attached to the staple cartridge portion 401*b*, and is disposed on the upstream side of the staple thrusting position 406 in terms of the sheet conveying direction. The staple thrusting position 406 thrusts staples housed in the cartridge one by one in the staple thrusting position. At least one end portion of the guide member 405 has a region that extends beyond the staple thrusting position 406 in terms of the sheet width direction.

The guide member 405 is attached to the intermediate stacking portion 402, and extends from the intermediate stacking portion 402 to the stapler H. The guide member 405 reaches the staple cartridge portion 401*b* across the stapler main body 401*a*.

Having at least one end portion extending beyond the staple thrusting position 406 in terms of the sheet aligning direction (the sheet width direction), the guide member 405 guides (an end portion of) each sheet S to the alignment plate 303*a* beyond the staple thrusting position 406, while the sheet S is not caught on the staple thrusting position 406 in a sheet aligning operation by the sheet aligning portion.

Figure 7A:
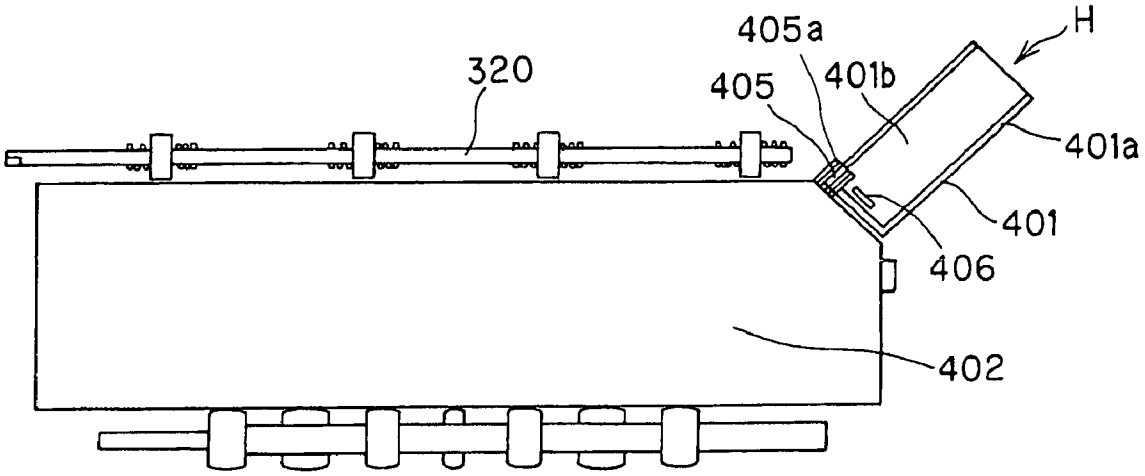
FIGS. 7A and 7B are views illustrating a sheet processing apparatus that has a guide member and has a stapling function according to the first embodiment.
Figure 7B:
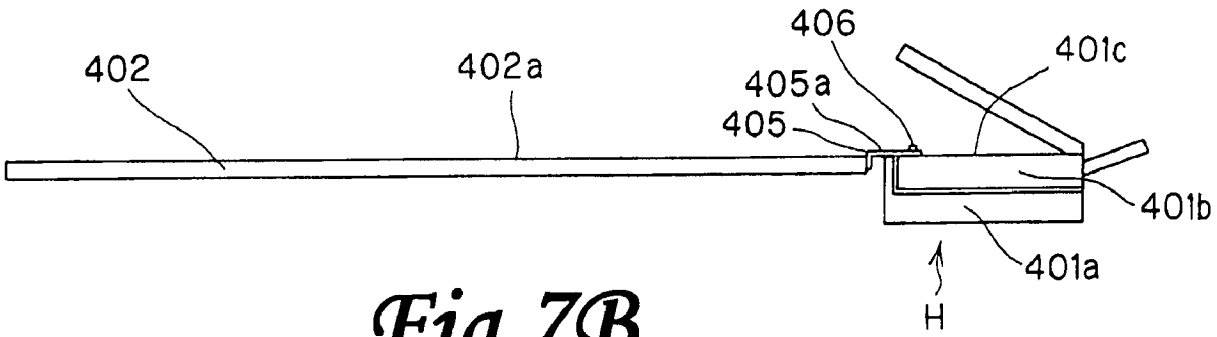

The guide member 405 at least extends beyond the end portion of the staple thrusting position 406 on the side of the intermediate stacking portion 402 in terms of the sheet width direction (or on the side of the middle of each sheet S in terms of the sheet width direction), as shown in FIGS. 7A and 7B. When projected in the sheet conveying direction, the guide member 405 is designed to have a region overlapping at least one region of the staple thrusting position 406.

The guide member 405 also fills the space between the stapling portion 401 and the intermediate stacking portion 402. More specifically, the guide member 405 is designed to fill the space between the staple thrusting position 406 and the intermediate stacking portion 402 between which each sheet being conveyed would be easily caught.

A guide face 405*a* of the guide member 405 that guides each sheet does not extend upward with respect to the sheet stacking face in the height direction of the sheet conveyance face. Instead, the guide face 405*a* remains at the same height as the sheet stacking face (the sheet conveyance face) 402*a* of the intermediate stacking portion 402 and a staple cartridge face 401*c* (or the staple thrusting position 406), so that each sheet to be conveyed can be guided without being caught (see FIG. 7B).

With this guiding structure, the space or the step between the portions can be completely filled. When the end of a sheet enters the opening of the stapler in the aligning operation performed in the direction substantially perpendicular to the sheet conveying direction, problems such as a sheet being caught in the space between the stapling portion 401 and the intermediate stacking portion 402 or the space between the stapler main body 401*a* and the staple cartridge portion 401*b* can be prevented with higher certainty.

Figure 8A:
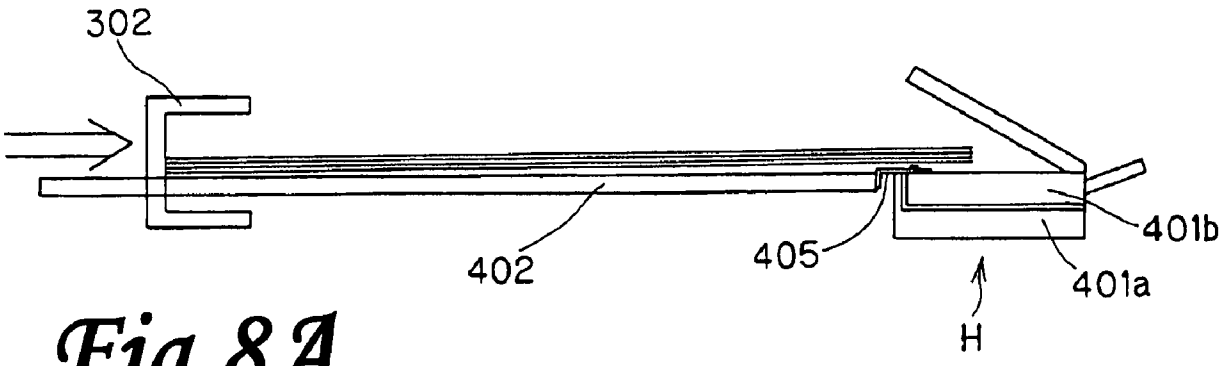
FIGS. 8A and 8B are views illustrating a stapling operation of a sheet processing apparatus that has a guide member and has a stapling function according to the first embodiment.
Figure 8B:
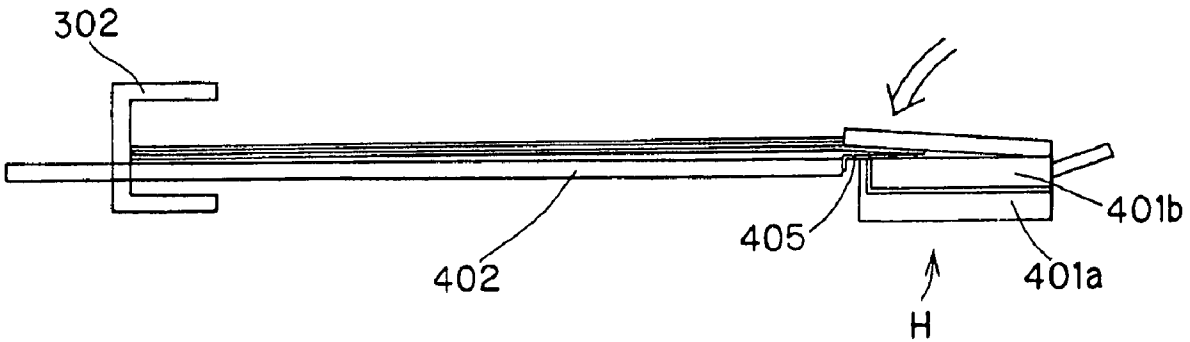
Figure 9A:
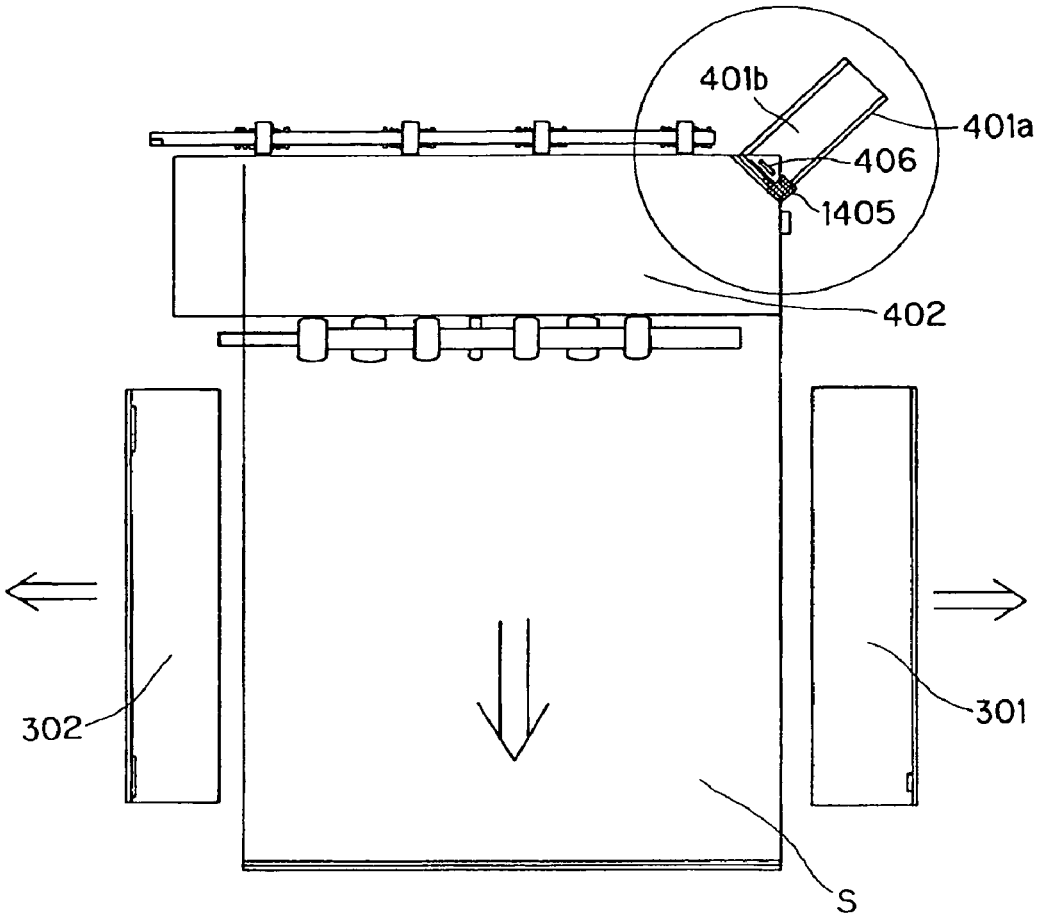
FIGS. 9A and 9B are views illustrating the bundle discharging operation in a stapling operation of a sheet processing apparatus as a comparative example that has a guide member and has a stapling function.
Figure 9B:
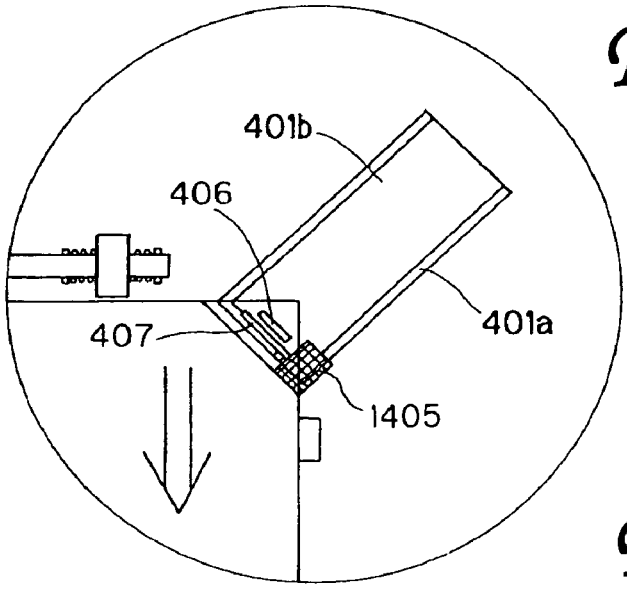

Thus, alignment in the direction substantially perpendicular to the sheet conveying direction can be certainly performed while the end portion of each sheet is prevented from getting caught, as shown in FIGS. 8A and 8B. Also, sheets are not aligned to the shape that extends upward near the guides during a sheet aligning operation. In an operation of stapling a bundle of sheets, the stapler portion 401 catches the guide member 405 as well as the bundle of sheets.

Being positioned so as not to overlap the staple thrusting position 406, the guide member 405 does not hinder stapling. Furthermore, the guide member 405 in the first embodiment is located on the upstream side of the staple thrusting position 406 of the staple cartridge portion 401*b* in terms of the sheet conveying direction, and extends from the intermediate stacking portion 402 to the staple cartridge portion 401*b*.

If the guide member 405 is located on the downstream side of the staple thrusting position 406 of the staple cartridge portion 401*b* in terms of the sheet conveying direction and extends to the staple cartridge portion 401*b*, as shown in FIGS. 9A and 9B, the following problem is caused: when a bundle of stapled sheets is discharged, the protruding portion of a finished staple 407 on the back face of the sheet at the bottom is caught by the guide member 1405. This problem can be solved in the first embodiment. The guide member 405 has at least one portion that is located on the upstream side of the staple thrusting position 406 of the staple cartridge portion 401*b* in terms of the sheet conveying direction. The guide member 405 may also extend toward at least one side of the staple thrusting position 406 in terms of the sheet width direction.

Although the guide face 405*a* of the guide member 405 is located at the same height as the sheet conveyance face and the staple cartridge face 401*c* (or the staple thrusting position 406) in this embodiment, the present invention is not limited to that arrangement, as long as the space between the sheet stacking face 402*a* and the staple cartridge face 401*c* (or the staple thrusting position 406) can be filled without a step that might catch a sheet being conveyed.

The sheet aligning portion of the first embodiment aligns sheets through the operations of the slide guide 301 and the slide guide 302. The mechanism for operating the slide guide 301 and the slide guide 302 is not limited to the mechanism described above, either.

Second Embodiment

Next, the structure of a guide member 408 of a sheet processing apparatus according to a second embodiment of the present invention is described. The same components as those of the first embodiment are denoted by the same reference numerals as those of the first embodiment, and explanation of them is omitted.

Figure 10A:
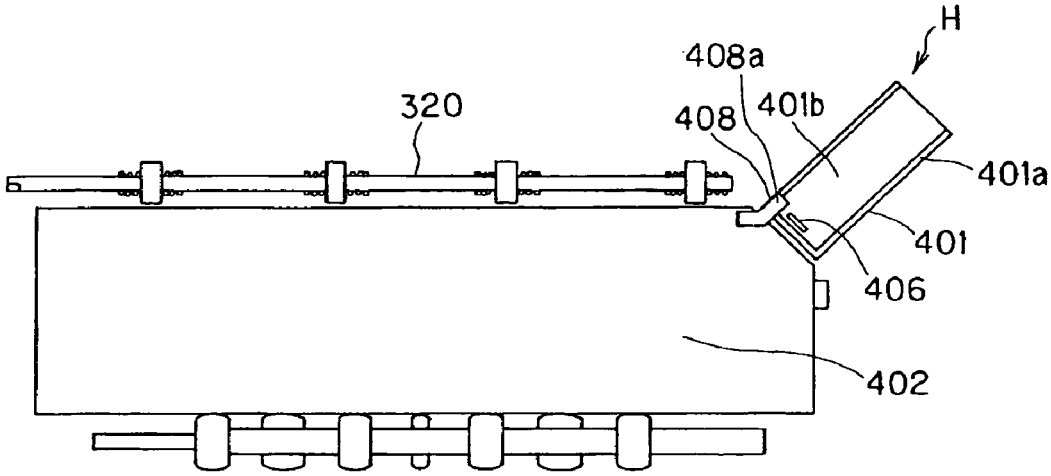
FIGS. 10A and 10B are views illustrating a sheet processing apparatus that has a guide member and has a stapling function according to a second embodiment.
Figure 10B:
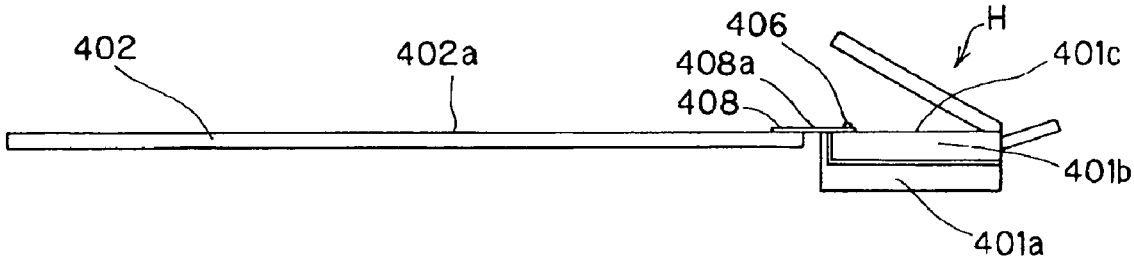
Figure 11:
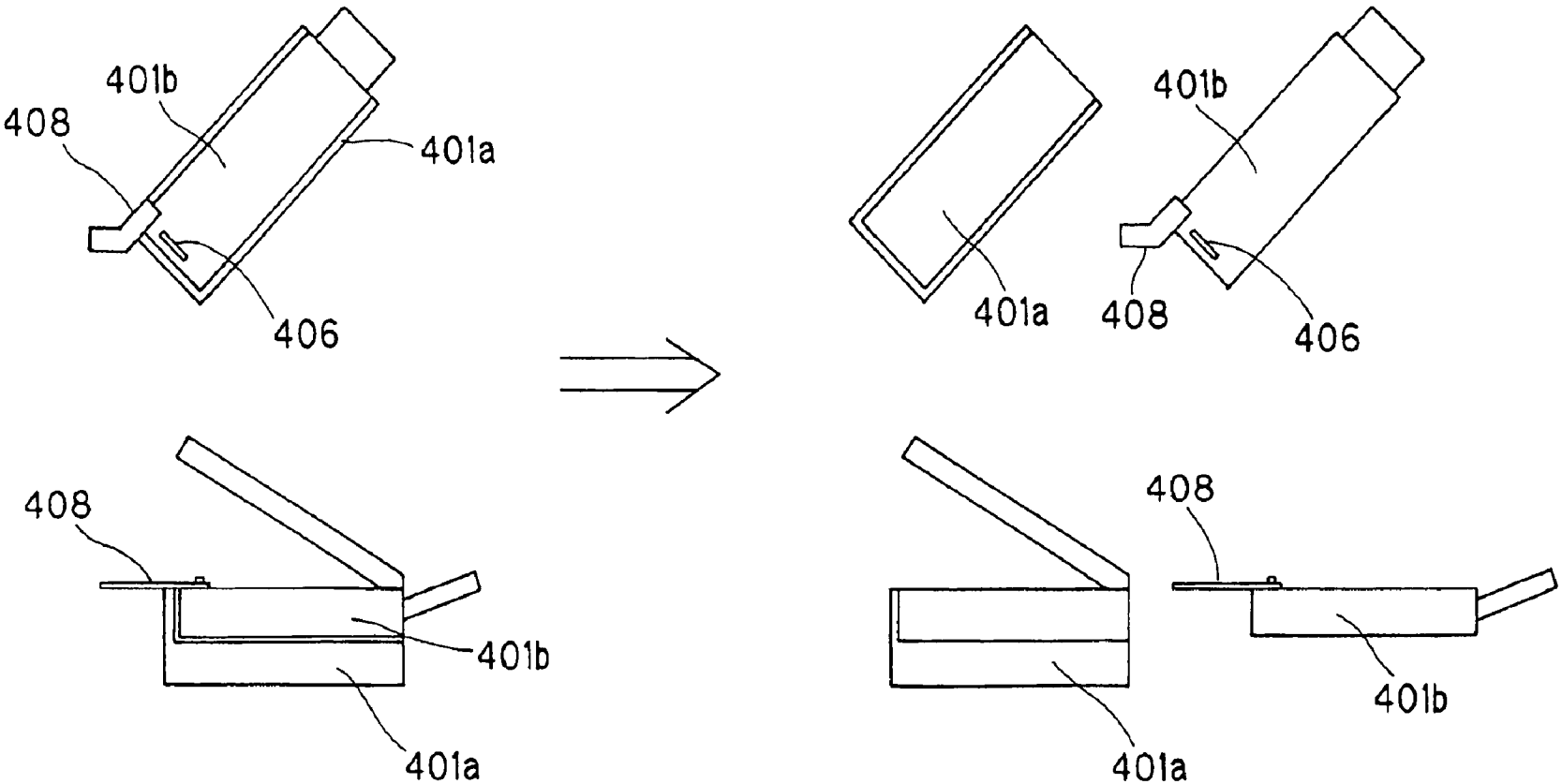
FIG. 11 is a view illustrating a stapling portion that has the guide member according to the second embodiment.

FIGS. 10A and 10B illustrate a sheet processing apparatus that has the guide member 408 and has a stapling function according to the second embodiment. FIG. 11 illustrates a stapling portion with the guide member 408 according to the second embodiment.

In the left half of FIG. 11, a stapling portion 401 on which a staple cartridge portion 401*b* is mounted is shown in a schematic plan view and a schematic cross-sectional view. In the right half of FIG. 11, the stapling portion 401 and a detached staple cartridge portion 401*b* are shown in a schematic plan view and a schematic cross-sectional view.

In the second embodiment, the guide member 408 is attached to the staple cartridge portion 401*b*, as shown in FIGS. 10A, 10B, and 11. The guide member 408 extends from the staple cartridge portion 401*b* to an intermediate stacking portion 402, and reaches the intermediate stacking portion 402 across the stapler main body 401*a*.

As in the first embodiment, a guide face 408*a* of the guide member 408 does not extend upward with respect to a sheet stacking face 402*a* in the height direction of the sheet conveyance face. In other words, the guide face 408*a* is at the same height as the sheet stacking face 402*a* and a staple cartridge face 401*c* (or a staple thrusting position 406), as shown in FIGS. 10A and 10B.

With this guiding structure, the space or the step between the portions can be completely filled. When the end of a sheet enters the opening of the stapler in the aligning operation performed in the direction substantially perpendicular to the sheet conveying direction, problems such as a sheet being caught in the space between the stapling portion 401 and the intermediate stacking portion 402 or the space between the stapler main body 401*a* and the staple cartridge portion 401*b* can be prevented with higher certainty.

Thus, alignment in the direction substantially perpendicular to the sheet conveying direction can be certainly performed while the end portion of each sheet is prevented from getting caught, as shown in FIGS. 8A and 8B. Also, sheets are not aligned to the shape that extends upward near the guides during a sheet aligning operation. In an operation of stapling a bundle of sheets, the stapler portion 401 catches the guide member 408 as well as the bundle of sheets.

Being positioned so as not to overlap the staple thrusting position 406, the guide member 408 in the second embodiment does not hinder stapling. Furthermore, the guide member 408 is located on the upstream side of the staple thrusting position 406 of the staple cartridge portion 401*b* in terms of the sheet conveying direction, and extends from the intermediate stacking portion 402 to the staple cartridge portion 401*b*.

If a guide member 1405 is located on the downstream side of the staple thrusting position 406 of the staple cartridge portion 401*b* in terms of the sheet conveying direction and extends from the intermediate stacking portion 402 to the staple cartridge portion 401*b*, as shown in FIGS. 9A and 9B, the following problem is caused: when a bundle of stapled sheets S is discharged, the protruding portion of a finished staple 407 on the back face of the sheet at the bottom is caught by the guide member 1405. This problem can be solved by the second embodiment.

In the second embodiment, the guide member 408 is integrally formed with a refill staple cartridge portion 401*b*. Therefore, every time the staple cartridge portion 401*b* is replaced with a new one, the guide member 408 is also replaced with a new one. Accordingly, there is no need to worry about the damage to the guide member 408 due to friction against a large number of sheets.

Third Embodiment

Next, the structure of a guide member 409 of a sheet processing apparatus according to a third embodiment of the present invention is described. The same components as those of the first and second embodiments are denoted by the same reference numerals as those of the first and second embodiments, and explanation of them is omitted.

Figure 12A:
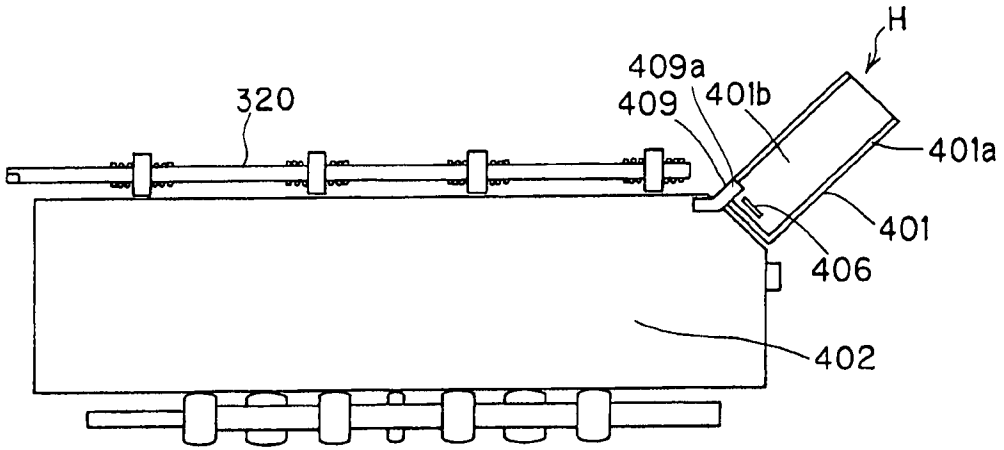
FIG. 12 is a view illustrating a sheet processing apparatus that has a guide member and has a stapling function according to a third embodiment.
Figure 12B:
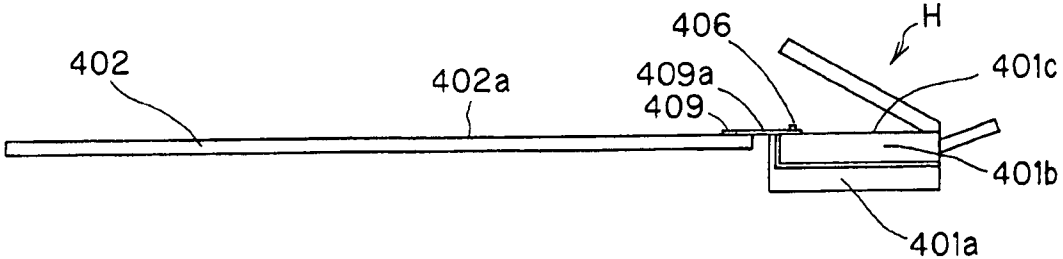
Figure 13:
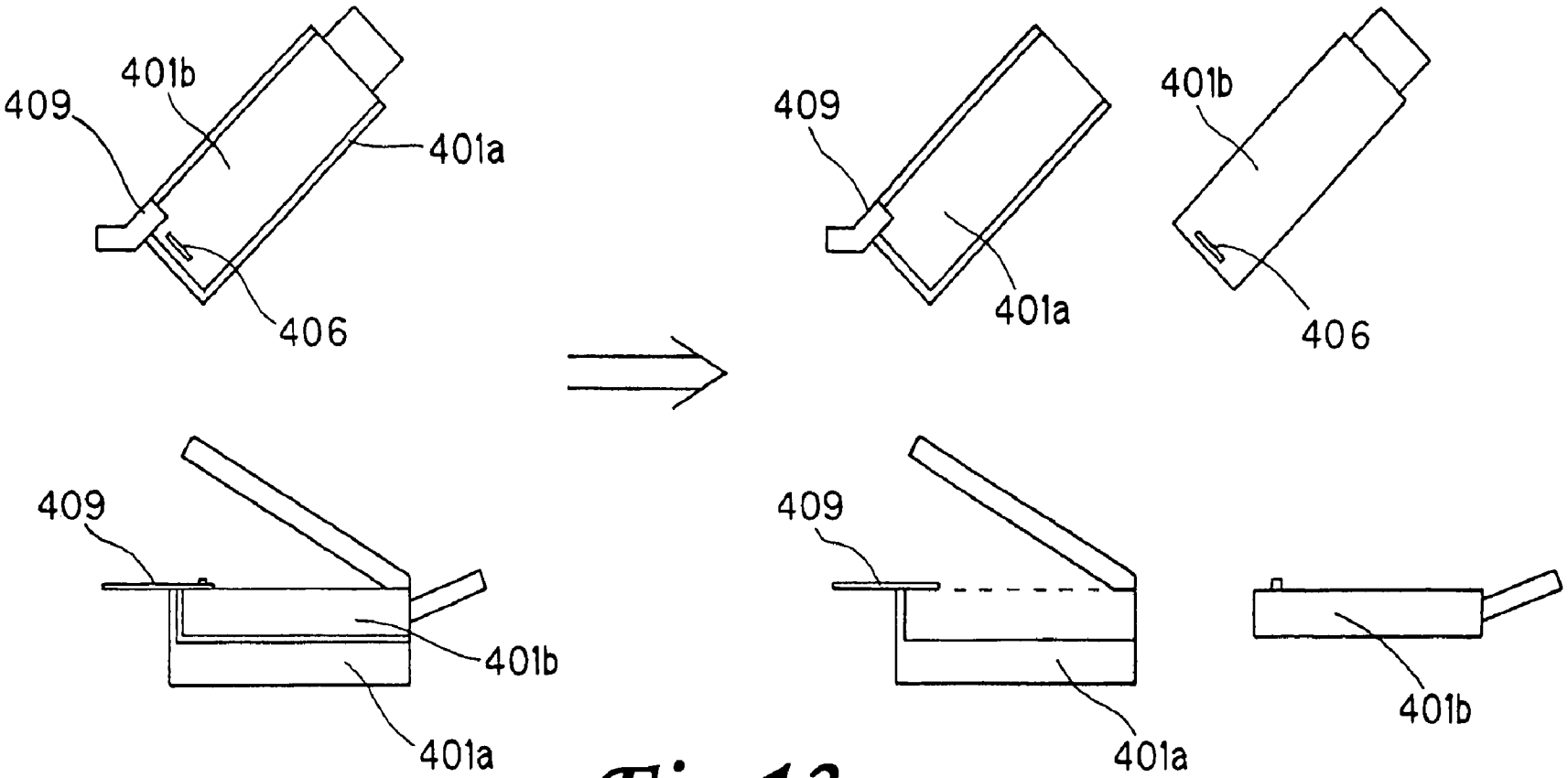
FIG. 13 is a view illustrating a stapling portion that has the guide member according to the third embodiment.
Figure 14:
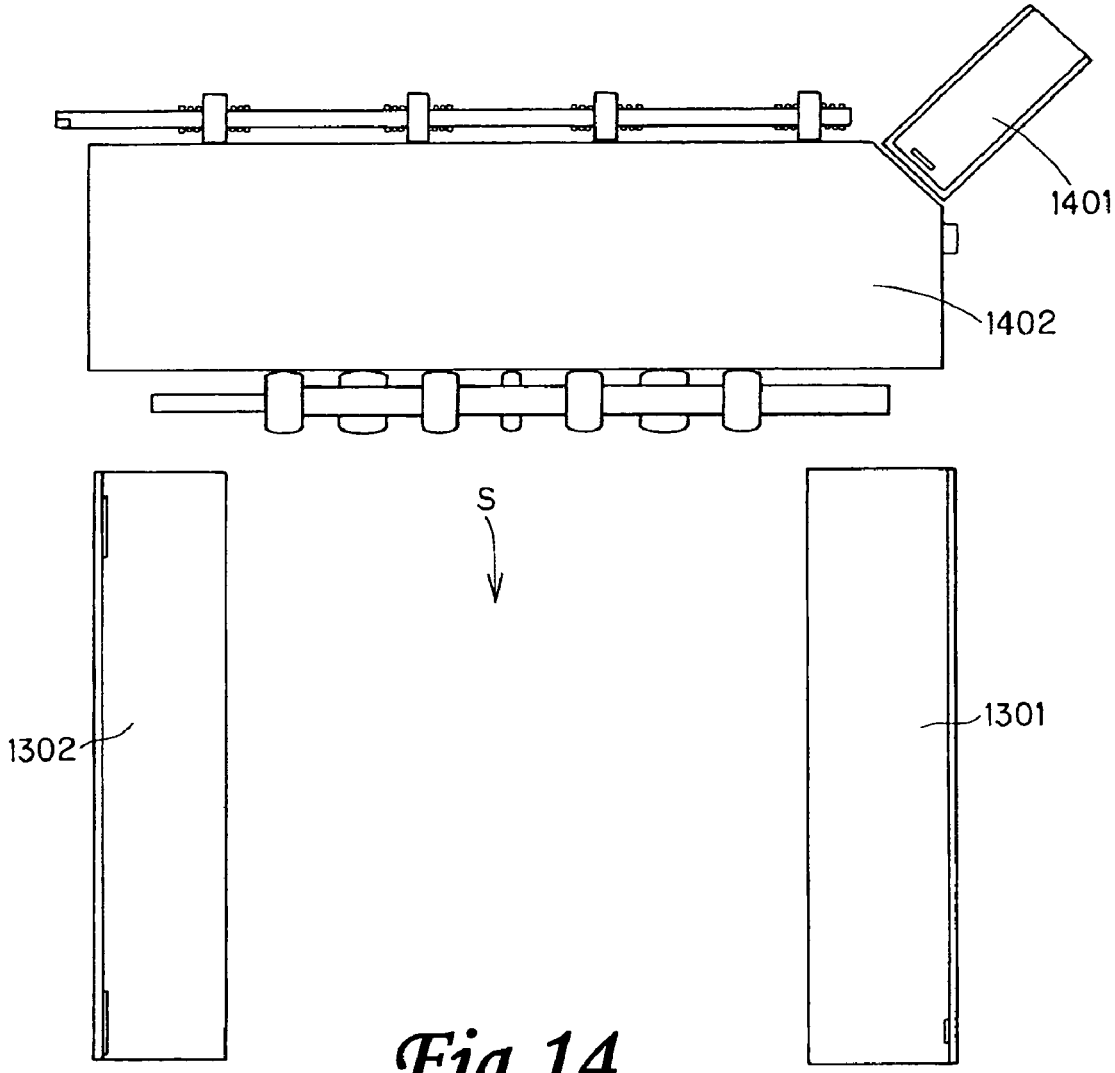
FIG. 14 is a view illustrating a conventional sheet processing apparatus that has a stapling function.
Figure 15:
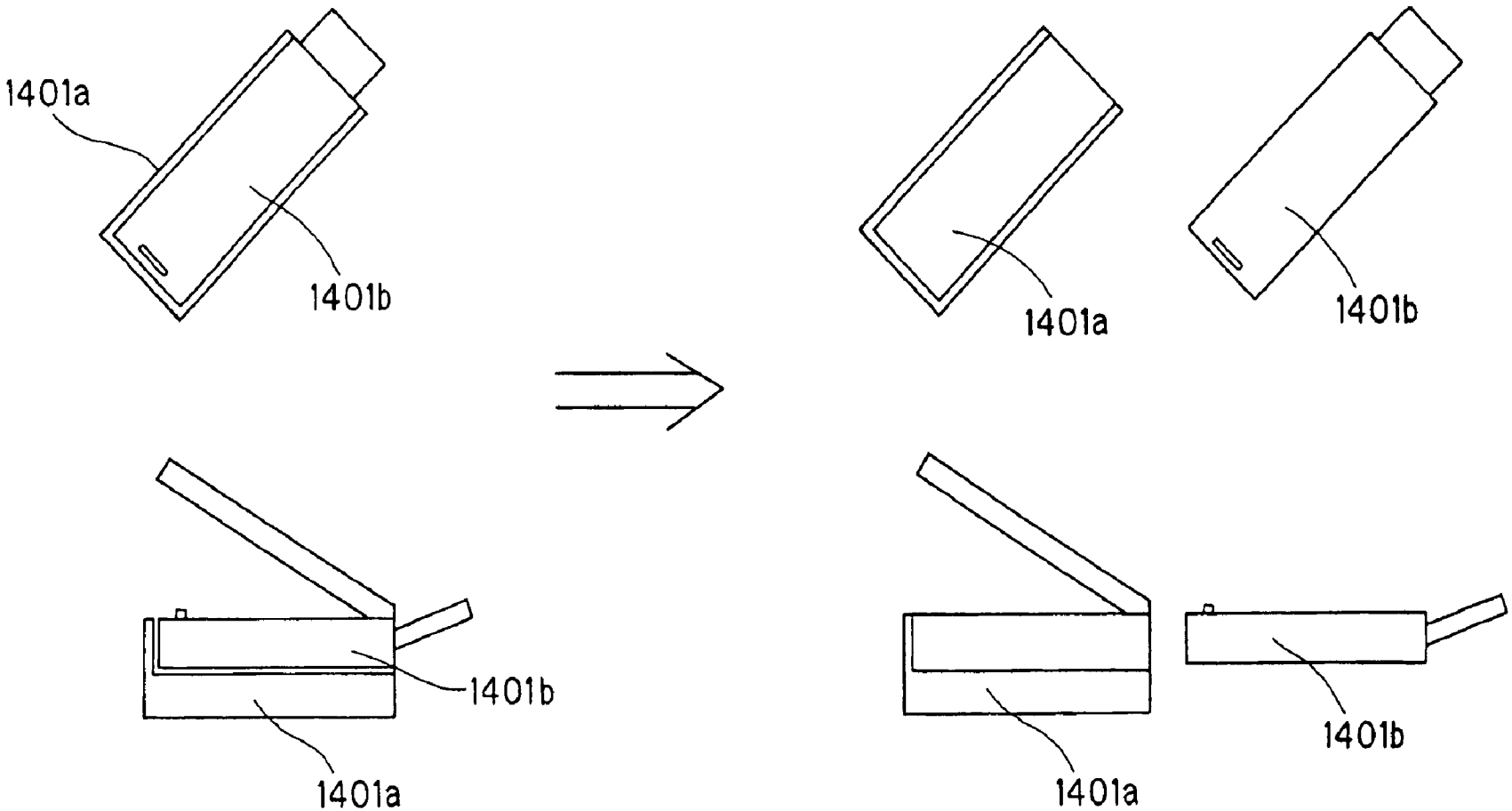
FIG. 15 is a view illustrating a conventional stapling portion.
Figure 16:
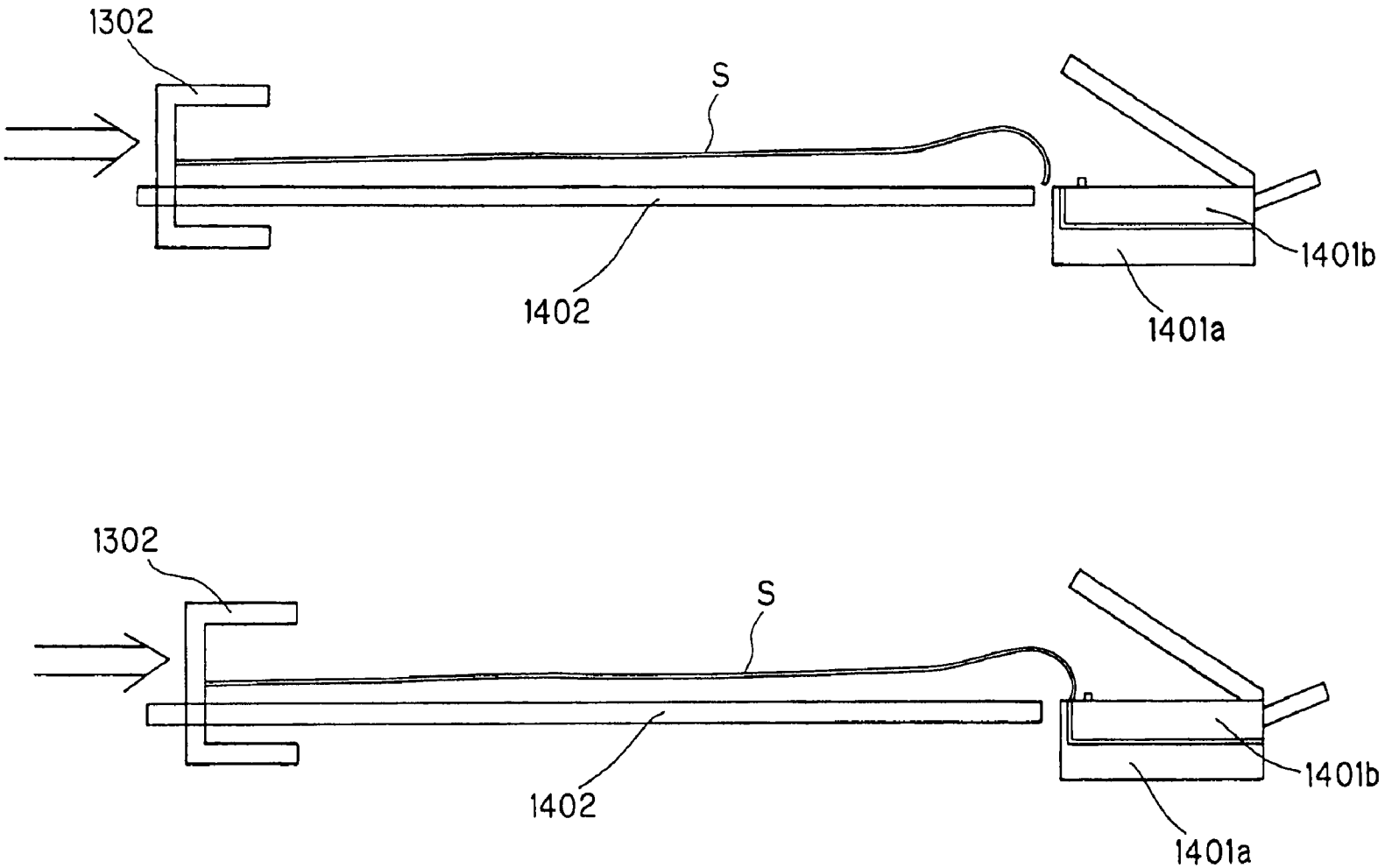
FIG. 16 is a view illustrating an aligning operation of a conventional sheet processing apparatus that has a stapling function.

FIGS. 12A and 12B illustrate a sheet processing apparatus that has the guide member 409 and has a stapling function according to the third embodiment. FIG. 13 illustrates a stapling portion with the guide member 409 according to the third embodiment. In the left half of FIG. 13, a stapling portion 401 on which a staple cartridge portion 401*b* is mounted is shown in a schematic plan view and a schematic cross-sectional view. In the right half of FIG. 13, the stapling portion 401 and a detached staple cartridge portion 401*b* are shown in a schematic plan view and a schematic cross-sectional view.

In the third embodiment, the guide member 409 is attached to the stapler main body 401*a*, as shown in FIGS. 12A, 12B, and 13. Each end portion of the guide member 409 extends toward the staple cartridge portion 401*b* and an intermediate stacking portion 402. The guide member 409 bridges the staple cartridge portion 401*b* and the intermediate stacking portion 402.

As in the first embodiment, a guide face 409*a* of the guide member 409 does not extend upward with respect to a sheet stacking face 402*a* in the height direction of the sheet conveyance face. The guide face 409*a* is also at the same height as the sheet stacking face 402*a* and a staple cartridge face 401*c* (or a staple thrusting position 406), as shown in FIGS. 12A and 12B.

With this guiding structure, the space or the step between the portions can be completely filled. When the end of a sheet enters the opening of the stapler in the aligning operation performed in the direction substantially perpendicular to the sheet conveying direction, problems such as a sheet being caught in the space between the stapling portion 401 and the intermediate stacking portion 402 or the space between the stapler main body 401*a* and the staple cartridge portion 401*b* can be prevented.

Thus, alignment in the direction substantially perpendicular to the sheet conveying direction can be certainly performed while the end portion of each sheet is prevented from getting caught, as shown in FIGS. 8A and 8B. Also, sheets are not aligned to the shape that extends upward near the guides during a sheet aligning operation. In an operation of stapling a bundle of sheets, the stapler portion 401 catches the guide member 409 as well as the bundle of sheets.

Being positioned so as not to overlap the staple thrusting position 406, the guide member 409 does not hinder stapling. Furthermore, the guide member 409 in the third embodiment is located on the upstream side of the staple thrusting position 406 of the staple cartridge portion 401*b* in terms of the sheet conveying direction, and extends to the staple cartridge portion 401*b*.

If the guide member 1405 is located on the downstream side of the staple thrusting position 406 of the staple cartridge portion 401*b* in terms of the sheet conveying direction and extends to the staple cartridge portion 401*b*, as shown in FIGS. 9A and 9B, the following problem is caused: when a bundle of stapled sheets S is discharged, the protruding portion of a finished staple 407 on the back face of the sheet at the bottom is caught by the guide member 1405. This problem can be solved by the third embodiment.

This application claims priority from Japanese Patent Application No. 2005-141993 filed May 13, 2005, which is hereby incorporated by reference, herein.

What is claimed is:

1. A sheet processing apparatus comprising:

a sheet stacking portion on which a sheet is stacked;

a sheet binding portion which performs a binding operation by thrusting a staple, at a staple thrusting position, into the sheets stacked on said sheet stacking portion;

a guide member which guides the sheet to be bound to the sheet binding portion, said guide member provided between the sheet stacking portion and the sheet binding portion; and a sheet discharge unit which conveys the sheets bound by the sheet binding portion, wherein the guide member is provided on an upstream side of the staple thrusting position in a sheet discharging direction of the sheet discharge unit.

2. The sheet processing apparatus according to claim 1, further comprising a sheet aligning portion which aligns the sheets stacked on the sheet stacking portion, the sheet aligning portion aligning the sheets to be bound in a predetermined position, wherein the sheet aligning portion has an aligning member which moves in a sheet width direction perpendicular to the sheet discharging direction, and the guide member has a guide face that extends from the sheet stacking portion beyond the staple thrusting position of the sheet binding portion in the sheet width direction.

3. The sheet processing apparatus according to claim 2, wherein the guide member has the guide face at least on one side of the staple thrusting position of the sheet binding portion in the sheet width direction.

4. The sheet processing apparatus according to claim 1, wherein the guide member does not have a guide face formed in the staple thrusting position of the sheet binding portion.

5. The sheet processing apparatus according to any of claims 2 to 4, wherein the guide face is designed to be located at the same height as a sheet stacking face of the sheet stacking portion and the staple thrusting position of the sheet binding portion, the sheet stacking face being located in the vicinity of a region in which the guide member is provided.

6. The sheet processing apparatus according to claim 1, wherein the guide member is designed to fill the space between the sheet stacking portion and the sheet binding portion.

7. The sheet processing apparatus according to claim 1, wherein the guide member is supported by the sheet stacking portion.

8. The sheet processing apparatus according to claim 1, wherein the sheet binding portion further comprises a cartridge portion that houses staples to be thrust during the binding operation; and a stapler main body that has the cartridge portion detachably attached thereto, and has a function of thrusting staples housed in the cartridge portion one by one in the staple thrusting position and a function of folding each thrust staple.

9. The sheet processing apparatus according to claim 8, wherein the guide member is supported by the cartridge part.

10. The sheet processing apparatus according to claim 8, wherein the guide member is supported by the stapler main body.

11. An image forming apparatus comprising:

an image forming portion which forms an image on a sheet; and the sheet processing apparatus as claimed in claim 1, which performs processing on the sheet on which the image is formed by the image forming portion.

* * * * *